United States Patent [19]

Green

[11] 4,135,982

[45] Jan. 23, 1979

[54] METHOD FOR PREVENTING PLUGGING IN THE PYROLYSIS OF AGGLOMERATIVE COALS

[75] Inventor: Norman W. Green, Upland, Calif.

[73] Assignee: Occidental Petroleum Corporation, Los Angeles, Calif.

[21] Appl. No.: 871,686

[22] Filed: Jan. 23, 1978

Related U.S. Application Data

[63] Continuation-in-part of Ser. No. 700,041, Jun. 25, 1976, abandoned, which is a continuation-in-part of Ser. No. 633,898, Nov. 20, 1975, which is a continuation of Ser. No. 449,073, Mar. 7, 1974, abandoned.

[51] Int. Cl.[2] ..... C10B 1/00; C10B 49/16; C10G 1/00

[52] U.S. Cl. ..... 201/12; 201/22; 201/28; 201/33; 202/99; 202/108; 208/8

[58] Field of Search ..... 201/7, 8, 9, 10, 12, 201/21, 22, 23, 28, 29, 32, 33, 34, 35, 36, 37, 38; 202/99, 108, 120, 121; 208/8, 11 R; 48/210 (U.S. only)

[56] References Cited

U.S. PATENT DOCUMENTS

| | | | |
|---|---|---|---|
| 2,935,466 | 5/1960 | Schoenmakers | 23/288 S X |
| 2,955,988 | 10/1960 | Sebastian | 201/42 X |
| 3,655,518 | 4/1972 | Schmalfeld et al. | 201/20 X |
| 3,867,110 | 2/1975 | Schora et al. | 48/210 |

*Primary Examiner*—Joseph Scovronek
*Attorney, Agent, or Firm*—Christie, Parker & Hale

[57] ABSTRACT

To prevent plugging in a pyrolysis operation where an agglomerative coal in a nondeleteriously reactive carrier gas is injected as a turbulent jet from an opening into an elongate pyrolysis reactor, the coal is comminuted to a size where the particles under operating conditions will detackify prior to contact with internal reactor surfaces while a secondary flow of fluid is introduced along the peripheral inner surface of the reactor to prevent backflow of the coal particles. The pyrolysis operation is depicted by two equations which enable preselection of conditions which insure prevention of reactor plugging.

48 Claims, 7 Drawing Figures

DURATION OF PLASTIC STATE
(WEST KENTUCKY COAL)

92μm
49μm
32μm
1800
1700
1600
1500
1400
1300
1200
1100
1000
0.0
0.5
0.10
0.15
θ, SECONDS
Tp, PYROLYSIS TEMPERATURE, °F

DURATION OF PLASTIC STATE
(PITTSBURGH SEAM COAL)

DURATION OF PLASTIC STATE COMPUTED FOR CHAR/COAL = 5/1
(WEST KENTUCKY COAL)

150μm
125μm
100μm
75μm
50μm
25μm
10μm
1800
1700
1600
1500
1400
1300
1200
1100
1000
0.00
0.05
0.10
0.15
θ, SECONDS
Tp, PYROLYSIS TEMPERATURE, °F

METHOD FOR PREVENTING PLUGGING IN THE PYROLYSIS OF AGGLOMERATIVE COALS

The Government has rights in or in respect of this invention pursuant to Contract No. E(49-18)-2244 awarded by the U.S. Energy Research & Development Administration.

CROSS-REFERENCE TO RELATED APPLICATIONS

This application is a continuation-in-part of Application Ser. No. 700,041 filed June 25, 1976, now abandoned which is a continuation-in-part of Application Ser. No. 633,898 filed Nov. 20, 1975, which is in turn a continuation of Application Ser. No. 449,073 filed Mar. 7, 1974, now abandoned, and assigned to the assignee of this invention.

BACKGROUND OF THE INVENTION

This invention relates to a method for controlling agglomeration of a caking coal so that the coal can be pyrolyzed in a continuous process without plugging the pyrolysis reactor.

The use of fluidized systems wherein a fluidized stream is formed of finely divided coal particles, heated char particles and a carrier stream to pyrolyze the coal particles to extract the volatiles therefrom is known in the art. In such prior art processes the heated char particles provide at least a portion of the requisite heat of pyrolysis to the coal particles with a supply of char continuously being produced upon pyrolysis of the coal in the system.

Agglomerative particulate bituminous coals are known to those skilled in the art to plasticize and become sticky or tacky at low temperatures, e.g., 400° to 850° F. Application of such prior art processes to agglomerative bituminous coal results in problems due to the agglomerative nature of such coal. When agglomerative coal particles are heated to their plastic state, and the heated particles contact a wall of a reactor, the particles can cake thereon to form a bubbly, compact mass which swells and then resolidifies, forming a solid coherent body with a porous structure, i.e. coke. Such agglomeration of coal particles on the reactor walls causes severe blockage in the system and renders the system inoperable.

To overcome plugging problems encountered in pyrolysis systems utilizing agglomerative coals, various procedures have been suggested by the prior art. In U.S. Pat. Nos. 2,955,077 and 3,375,175 an agglomerative particulate coal is preheated in a fluidized bed at temperatures ranging from 600° F. to 825° F. for from 1 to 30 minutes to remove at least a portion of the volatiles from the coal so the coal can be further pyrolyzed to recover the volatiles therefrom. The requirement of preheating agglomerative bituminous coals for long residence times imposes severe economic limitations on these processes.

In U.S. Pat. No. 3,736,233 there is disclosed a continuous process for pyrolysis of agglomerative bituminous coal by heating the particulate coal having a particle size of less than 65 microns with char, both of which are entrained in a carrier gas having pyrolysis reactor residence times of under three seconds. This patent also suggests that it may be helpful to use a reactor having porous walls through which a gas is continuously passed to prevent sticking of particles to the reactor walls.

U.S. Pat. No. 3,357,896 discloses heating large particles of caking coal through their plastic range in a free fall system to avoid contact with the reactor walls and to produce noncaking coal char. The patent also discloses the use of oxygen in the heating gas to prevent caking of the coal while it is heated through its plastic range. Such treatment with oxygen has the disadvantage that it substantially reduces the yield of hydrocarbons produced during pyrolysis.

Still another prior art process employs sodium carbonate to decrease agglomeration of the coal.

Other processes for making noncaking coal and chars from highly caking coals are complex and require expensive mechanical devices such as rotating kilns, chain grates, jiggling grates, and rotating screws to prevent caking coals from fusing into one solid mass while being taken through the plastic temperature range. Such equipment makes these conversion processes expensive.

To applicant's knowledge, none of the prior art processes has proved completely satisfactory, and very few of such prior art processes are practiced commercially.

Therefore, there is need for an efficient, economical, continuous method for pyrolyzing agglomerative coals in a transport reactor for recovery of volatile hydrocarbons under conditions which prevent plugging of the reactor.

SUMMARY OF THE INVENTION

According to the present invention there is provided a process for the pyrolysis of agglomerative coals under conditions which effectively preclude plugging of the reactor surfaces due to the formation of tacky coal deposits thereon.

In the process of this invention a coal feed stream comprising particulate agglomerative coal in a carrier gas which is substantially nondeleteriously reactive with respect to the products of pyrolysis is injected from a feed opening into an elongate pyrolysis reactor. The maximum width of the opening is less than the minimum width of the reactor interior. Injection is at a temperature below the temperature at which the coal begins to tackify and as a jet under turbulent flow conditions, i.e. a Reynolds number of at least 2000. There is simultaneously injected along the inner peripheral surface of the reactor a fluid in a quantity at least sufficient to prevent backflow of the particle coal. The fluid may enter the reactor at a velocity greater than, equal to, or less than the coal; comprises a gas which is nondeleteriously reactive with respect to the products; and preferably contains a particulate source of heat to supply the heat required for pyrolysis. The fluid combines with the constituents of the diverging jet in a mixing zone ahead of a pyrolysis zone and passes to a pyrolysis zone where at a selected temperature greater than the temperature of the coal at the softening point, the coal undergoes pyrolysis to form vaporized recoverable hydrocarbons and carbon containing solid residue of pyrolysis. To achieve trouble free operation, the coal particles contained in the jet are formed of particles of a size which pass through their tacky state or detackify in transit and prior to contact with a fixed interior surface of the reactor spaced from the opening. It is preferred that the velocity of the fluid surrounding the jet be less than the exit velocity of the coal from the opening.

To carry out the process of this invention and control operating conditions to insure plugging is precluded, the dynamics of its operation has been characterized. The maximum width of the opening considered with the minimum width of the reactor, injection temperature of the fluid, and injection velocity and temperature of the coal provide a design variable $\phi$ expressed in seconds or other time equivalent which is the minimum time required for a coal particle to travel from the opening to the next closest fixed inner surface of the pyrolysis reactor. To avoid reactor plugging, $\phi$ is greater than or equal to $\theta$, the tacky time for the coal. An overall pyrolysis operation at the approach of plugging can be expressed in terms of the following equations:

$$D^2 = \frac{12K\phi}{\rho C \ln\left[\frac{(Tp - To)}{(Tp - Tt)}\right]}$$

and $$1/D^2 = \frac{\rho C}{\tau 12K} e^{-\alpha/Tp} [(E_1(x_a) - E_1(x_b)) - (E_1(x_c) - E_1(x_d))]$$

wherein

D is maximum coal particle diameter in feet;

K is the thermal conductivity of the carrier and fluidizing gases, in combination, in Btu/sec-ft-°R;

$\phi$ is the minimum time required for a coal particle to travel from the opening to an interior fixed surface of the reactor in process;

$\rho$ is the apparent particle density of the coal, lb/ft$^3$;

C is the specific heat of the coal, Btu/lb -°R;

Tp is the temperature of the pyrolysis in °R;

To is the introduction temperature of the coal in °R;

Tt is the temperature of the coal at the end of the tacky period of the coal in °R;

$\tau$ is the plastic time constant for the coal at a predetermined solid source of heat to coal ratio in seconds;

$\alpha$ is the exponential temperature factor for detackification of the coal, °R;

$E_1(x_a)$ is the exponential integral of $x_a = (\alpha/Tt - \alpha/Tp)$;

$E_1(x_b)$ is the exponential integral of $x_b = (\alpha/To - \alpha/Tp)$;

$E_1(x_c)$ is the exponential integral of $x_c = \alpha/Tt$;

$E_1(x_d)$ is the exponential integral of $x_d = \alpha/To$; and $$E_1(x) = \int_x^\infty \frac{e^{-q}\,dq}{q}$$

where x is a designated value and q a dummy variable and $E_1$ is the operator described in "Handbook of Mathematical Functions, National Bureau of Standards AMS55," page 228, definition 5.1.1 (1964).

To determine proper operation all but one of the variables D, $\phi$, To, Tp are fixed for the reactor and the remaining variable is determined. If D is the value determined, the particle size of the largest coal particles must be less than D; if To is determined the actual To must be higher; and if Tp is determined, the actual pyrolysis temperature must be higher. For a typical operation Tp is fixed as it controls the product composition and the other values are accordingly fixed. Of them, particle diameter is the variable most readily controlled and the normal adjusting variable. The ratio of solid source of heat to coal is less variable as in the preferred operation it is the source of heat and the quantity fixed by Tp. Given a selected set of operating conditions, the equations may also be used to determine the design criteria for the reactor and for this purpose $\theta$ is substituted for $\phi$ in the equations and $\phi$ must be greater than or equal to $\theta$.

Depending on the products to be obtained, pyrolysis occurs at a selected temperature Tp above about 1060°R, preferably from about 1060° to about 2460°R and more preferably from about 1360° to about 1860°R. Where a solid particulate source of heat is employed to sustain the selected pyrolysis temperature, the weight ratio of the solid particulate source of heat will range from about 2:1 to about 20:1. External heating and/or heating by the fluid introduced along the internal reactor periphery may be used instead of heating by the particulate source of heat.

DRAWINGS

These and other features, aspects, and advantages of the present invention will become more apparent with respect to the following description, appended claims and accompanying drawings where:

FIG. 1 schematically shows a process for pyrolysis of agglomerative coals embodying features of the present invention;

DESCRIPTION

Figure 1:
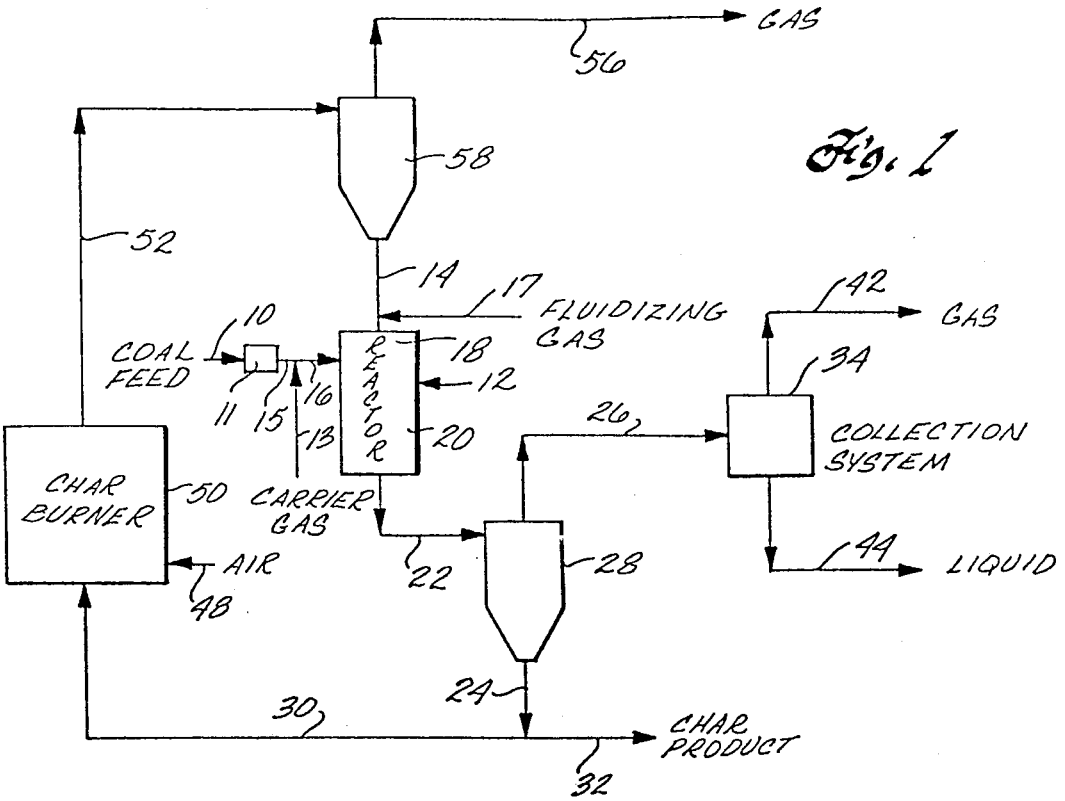

With reference to FIG. 1, an agglomerative coal feed stream 10 is comminuted in a comminution stage 11. As used herein, the term "agglomerative coal" denotes a caking coal, which is generally a bituminous coal, and the term "comminution" refers to any physical or chemical act of size reduction including, but not limited to chopping, crushing and grinding by suitable machinery. Comminution of the coal increases the surface area to volume ratio for efficient pyrolysis.

The coal can be further prepared for pyrolysis before and/or after comminution by at least partially drying the coal to reduce the heat load in the pyrolysis reactor for vaporizing the water in the coal and by removal of magnetic particles.

The comminuted coal is introduced into a pyrolysis reactor 12. A carrier gas 13 which is nondeleteriously reactive with respect to pyrolysis products can be used to convey the coal into the pyrolysis reactor 12. By a "nondeleteriously reactive" carrier or transport gas, there is meant a gas stream which is substantially free of free oxygen. Gases such as nitrogen or steam, and preferably gases resulting from the pyrolysis of the coal, can be used as a carrier gas. Also preferred is a hydrogen-enriched carrier gas, where the hydrogen can be generated by the reaction of steam with the carbon containing solid residue of pyrolysis of the coal.

The coal is combined in the pyrolysis reactor 12 with a particulate source of heat, preferably a hot char stream 14. A fluidizing gas 17 which is nondeleteriously reactive with respect to pyrolysis products is used to transport the particulate source of heat to the pyrolysis reactor. To obtain maximum utilization of the particulate source of heat, the transport gas for the particulate source of heat can have a temperature approaching the temperature of the particulate heat source.

The particulate heat source is a material capable of transferring heat to the coal to cause its pyrolysis into volatilized hydrocarbons and char. The heat source preferably employed is the solid product resulting from pyrolysis of the carbonaceous material, such as char or coke. The char serves to prevent agglomeration and to provide at least a portion of the heat required for pyrolysis. The selection of the mass ratio of the hot particulate char to the coal particles depends upon the heat transfer requisites of the system, the tendency of the coal particles to agglomerate, and the amount of the heat of pyrolysis which is supplied by the carrier gas. The temperature, flow rate, and residence time in the reactor depend upon the particular system undergoing pyrolysis. In general, for economy sake, it is preferred to utilize char particles produced by the pyrolysis of the coal as the main source of heat.

In a mixing region or zone 18 of the pyrolysis reactor 12 the coal feed stream 16 comprising the particulate comminuted coal 15 and its carrier gas 13, the char 14 and the char's fluidizing gas 17 are combined to form a pyrolysis feed stream which reacts in a pyrolysis reaction zone 20 of the pyrolysis reactor to yield a pyrolysis product stream 22 containing as solids the char serving as the particulate source of heat and char formed by the pyrolysis of the feed coal, and a vapor mixture. The vapor mixture contains the carrier and the fluidizing gases fed to the pyrolysis reactor 12 and products of pyrolysis such as carbon oxides, water vapor, hydrogen, and volatilized hydrocarbons.

By the term "volatilized hydrocarbons" there is meant the hydrocarbon containing gases produced by pyrolysis of the coal. In general, these consist of condensible hydrocarbons in vapor form which can be recovered by simply contacting the volatilized hydrocarbons with condensation means, and noncondensible gases such as methane and other hydrocarbon gases which are not recoverable by ordinary condensation means.

The coal is heated to its decomposition temperature in the pyrolysis reactor 12 within a fraction of a second, i.e. about 0.1 second or less.

The reactor 12 is operated, depending upon the temperature and the nature of the particulate heat source, at a temperature of from between about 600° F. and the introduction temperature of the hot char. The reactor temperature is sustained essentially by the hot char.

In the pyrolysis reactor, heat transfer occurs primarily by a solid-to-gas-to-solid convective mechanism with some solid-to-solid radiative and conductive heat transfer occurring.

The operating pressure of the pyrolysis reactor is usually above atmospheric pressure. As the pressure is increased, compression of the carrier gas and the volatilized hydrocarbons results. This allows use of lower volume downstream separation equipment.

Generally, high solids content in the pyrolysis feed stream is desired to minimize equipment size and cost. However, preferably the pyrolysis feed stream contains sufficient carrier gas that the feed stream has a low solids content ranging from about 0.1 to 10% by volume based on the total volume of the stream to provide turbulence for rapid heating of the coal and to dilute the coal particles and help prevent them from agglomerating. Rapid heating results in high yields and prevents agglutination of agglomerative coals. The solids in the pyrolysis feed stream are divided between coal and char with a char to coal weight ratio of from about 2 to about 20:1. The high ratio of char to coal helps prevent agglomerative coal particles from sticking together. The particulate char has a temperature consonant with the requirements of the pyrolysis zone, depending on the coal and carrier gas temperatures, and the mass ratios of the coal, char and carrier gas. At the above char to coal ratios, the temperature of the particulate char is about 100° to about 500° F. higher than the pyrolysis zone temperature.

The temperature in the reaction zone is from at least about 600° F. to about 2000° F. It has been found that the type of product and total yield of product are highly dependent upon the temperature in the reaction zone. As the temperature in the reaction zone increases above about 1400° F. the volatilized hydrocarbons from the pyrolysis reaction contain increasing amounts of noncondensible product gas. The particulate coal is heated to a temperature from about 900° F. to about 1400° F., and optimumly to about 1075° F. to produce high yields of volatilized hydrocarbons containing a high percentage of valuable middle distillates. Middle distillates are the middle boiling hydrocarbons, i.e., $C_5$ hydrocarbons to hydrocarbons having an end point of about 950° F. These hydrocarbons are useful for the production of gasoline, diesel fuel, heating fuel, and the like.

The maximum temperature in the pyrolysis reactor is limited by the temperature at which the inorganic portion of the coal softens with resultant fusion or slag formation. A pyrolysis temperature of 2000° F. is about the maximum that can be achieved without slag formation with agglomerative coals.

The pyrolysis time in the reaction zone depends upon a variety of factors such as the temperatures of the components, nature of the coal feed, etc. The residence time in the reaction zone preferably is less than about 5 seconds, and more preferably from about 0.1 to about 3 seconds to maximize the yield of volatilized hydrocarbons, with longer residence times at lower pyrolysis temperatures. Longer pyrolysis times can lead to cracking of the volatilized hydrocarbon produced during pyrolysis, with reduced yield of condensible hydrocarbons.

As used herein, "pyrolysis time" means the time from when the coal contacts the particulate source of heat until the pyrolytic vapors produced by pyrolysis are separated from the spent particulate source of heat. A convenient measure of pyrolysis time is the average residence time of the carrier gas in the pyrolysis section of the pyrolysis reactor and the cyclone separators downstream of the reactor. Sufficient pyrolysis time must be provided to heat the coal to the pyrolysis temperature.

Figure 2:
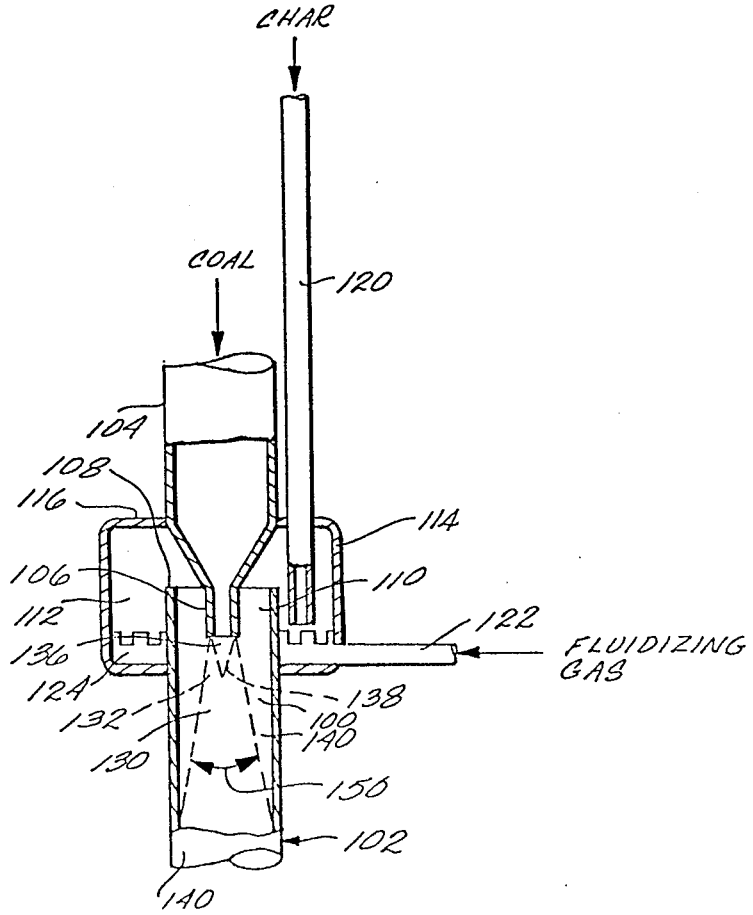
FIG. 2 is a section in elevation of a reactor for pyrolysis of agglomerative coals in accordance with principles of this invention.

An apparatus useful for combining char and coal in the mixing section of a pyrolysis reactor is shown in FIG. 2. Using such an apparatus, the char and coal streams are intimately mixed under turbulent flow conditions to ensure efficient pyrolysis reaction and good heat transfer from the hot particulate char to the coal feed stream without forming coke deposits on the reactor walls.

With reference to FIG. 2, the coal feed stream contained in a carrier gas enters a substantially vertically oriented mixing section 100 of a substantially vertically oriented, descending flow pyrolysis reactor 102 through a generally upright, annular first inlet 104, terminating within the mixing section and constricted at its end 106 to form a nozzle so that a fluid jet is formed thereby. The pyrolysis reactor 102 is annular and has an upper end 108, which is an open end of larger diameter than the nozzle 106, thereby surrounding the nozzle and leaving an annular gap 110 between the upper end 108 of the reactor and the nozzle 106.

An annular fluidizing chamber 112 is formed by a tubular section 114 with an annular rim 116 connected to the first inlet wall 104 above the nozzle 106. The chamber 112 surrounds the bottom portion of the nozzle 106 and the upper end 108 of the reactor.

A second annular inlet 120 is generally vertically connected to the annular fluidizing chamber 112, therefore receiving a fluidized stream of char. The second annular inlet discharges char into the fluidizing chamber below the top edge of the reactor so that incoming char builds up in the fluidizing chamber 112 and is restrained by the weir formed by the upper end 108 of the reactor to form a solids seal. The char is maintained in a fluidized state in the chamber 112 by a fluidizing or aerating gas which is substantially nondeleteriously reactive with respect to pyrolysis products fed through inlet 122 and an annular grid 124 into the chamber. The char in the chamber 112 passes over the upper end of the overflow weir and through the opening 110 between the weir and the nozzle into the mixing section of the reactor. An advantage of this weir-like configuration is that an essentially steady flow of fluidized char enters the mixing section because the mass of the char backed up behind the upper end of the reactor damps minor fluctuations in the char flow.

The char passing into the mixing section of the reactor is accompanied by fluidizing gas to prevent backmixing of the coal in the mixing section which could result in caking of coal on the reactor walls.

In the mixing zone 100 of the pyrolysis reactor, the particulate agglomerative coal contained in the carrier gas is discharged from the nozzle as a fluid jet 130 expanding towards the reactor wall at an angle of divergence of about 20° or less as shown by lines 132 representing the periphery of the fluid jet. Once the particulate source of heat is inside the mixing section, it falls into the path of the fluid jet 130 and is entrained thereby, yielding a resultant turbulent mixture of the particulate source of heat, coal feed, and the carrier gas. The jet has a free core region 136 of coal, as delineated by the V-shaped dotted line 138 extending considerably into the reactor. In the region 140 between the reactor walls and the fluid jet 130 there is unentrained particulate source of heat. The particulate source of heat along the periphery 132 of the fluid jet heats the coal through the tacky state before the coal strikes the reactor walls in accordance with principles of this invention. This mixing of the particulate source of heat with the coal in the mixing zone initiates heat transfer from the char to the coal, causing pyrolysis to occur in a substantially vertically oriented pyrolysis section 140 of the pyrolysis reactor.

In the apparatus shown in FIG. 2, the char entering through the second inlet is maintained at a rate of flow less than turbulent and the coal and carrier gas stream entering via the first inlet is maintained under turbulent flow at a rate sufficiently high that the resulting mixture stream from the contacting of the char and coal is under turbulent flow. Turbulent flow results in intimate contact between the coal and char particles, thereby yielding rapid heating of the coal by the char which improves yield. As used herein "turbulent" means the stream has a Reynolds flow index number greater than about 2000. The Reynolds number is based on the carrier gas at operating conditions. Laminar flow in the pyrolysis reactor tends to severely limit the rate of heat transfer within the pyrolysis zone. Process parameters such as the nozzle diameter and mass flow rate of the particulate coal and its carrier gas are varied to maintain the flow rate of the coal and carrier gas stream entering via the first inlet in the tubulent mixing region.

Preferably the nozzle 106 is protected from wear by being refractory-lined, or it may be lined with any conventional material such as annealed stainless and cast steels, and the like.

The end of the coal feed inlet preferably is cooled as by water, or protected by radiation shields, because the inlet can be heated above the point at which the coal becomes tacky due to heat transfer from the char surrounding the end of the solids feed inlet.

Although FIG. 2 shows a coal feed inlet having a nozzle at the end to achieve high inlet velocities into the mixing region, a nozzle is not required. Alternatively, the coal and its carrier gas can be supplied at a sufficient velocity to the inlet so that the resultant mixture is under turbulent flow without need for a nozzle.

Referring to FIG. 1, the effluent pyrolysis product stream 22 from the pyrolysis reaction zone contains char and a vapor mixture comprising volatilized hydrocarbons and carrier and fluidizing gases. At least the bulk of the char 24 is separated from the vapor mixture 26 in a solid/vapor separator stage 28 such as one or more cyclones in series. At least a portion of the separated char 24 is recycled as a char stream 30 to form the particulate source of heat. The remainder of the char represents the net solid product obtained by the pyrolysis of the coal and is withdrawn as char product 32.

The char stream 30 is subjected to at least partial oxidation in the presence of a source of oxygen such as air 48 in a char burner 50. Exothermic oxidation of carbon in the char in the char burner 50 raises the char to a temperature consonant with the requirements of the pyrolysis reactor. The effluent stream 52 from the char burner contains hot char, gaseous combustion products of the char, and nonreactive components of the source of oxygen, such as nitrogen. At least the bulk of the char is separated from these gases 56 in a gas/solid separation zone 58 such as one or more cyclones in series. The separated char stream is then introduced as the particulate source of heat 14 to the mixing section 18 in the pyrolysis reactor 12.

Initially the system is started up by using char generated outside the process as the char stream fed to the char burner. But after coal particles have had their volatiles removed, they are useful as the source of char particles required by the system. Char is produced in such excess that it is readily available for further processing to provide new materials which enhance the total economics of the process such as fuel for use in a power plant or as a source of raw material for the chemical industry.

The vapor mixture from the solid/vapor separation zone 28, which contains volatilized hydrocarbons and nonhydrocarbon gases such as carbon monoxide, hydrogen, carbon dioxide, hydrogen sulfide, and water is passed to a collection system 34 for rapid cooling to avoid decomposition. The condensible volatilized hydrocarbons are separated and recovered as liquid product 44 by conventional separation and recovery means such as venturi scrubbers, indirect heat exchangers, wash towers, and the like in the collection system.

Uncondensed gases 42 from the collection system can be further processed by conventional techniques. Hydrogen sulfide and carbon dioxide can be removed by conventional means such as chemical scrubbing. The remaining gases can be recovered as product streams. All or part of the gas stream can be utilized for carrying the comminuted coal to the pyrolysis reactor 12.

According to the method of this invention, a pyrolysis reactor such as a reactor shown in FIG. 2 can be operated for an agglomerative coal without caking of the coal on the reactor walls. This is accomplished by selecting reactor geometry, the temperature and mass flow rates of the incoming streams to the reactor, and the maximum particle size of the coal feed so that the time required for the largest of the coal particles to become detackified, $\theta$, is less than the minimum time, $\phi$, that it takes an incoming coal particle to reach a surface internal of the reactor from the opening. When this criterion is satisfied, caking of coal on the walls of a reactor does not occur.

There will now be described how $\theta$ and $\phi$ can be determined and how this basic principle is applied to the design and operation of a pyrolysis reactor for agglomerative coals.

Calculating $\phi$

The shortest time required for a coal particle to strike a surface of a reactor is equal to the shortest distance between the inlet for the coal feed stream and the surface of the reactor closest to the inlet divided by the average velocity of a coal particle along that path. For example, with reference to FIG. 2, when the coal is introduced from a tubular, vertical nozzle 106 into a vertical tubular pyrolysis reactor 102 concentric with the nozzle and incoming free-jet of coal diverges from the nozzle at an angle of divergence, $\beta$, as shown by line 156, then $\phi$ can be determined according to the following equation:

$$\phi = \frac{To}{Tp} \; \frac{1}{36\, v_p \tan \beta/2} \; \frac{R_r^3 - R_n^3}{R_r^2} \qquad (1)$$

where

- $v_p$ = the inlet velocity of the coal into the reactor;
- $\beta$ = the angle of divergence of the coal feed stream from the inlet nozzle;
- $R_r$ = the shortest distance from the axis of the nozzle at the end thereof to an internal wall of the reactor;
- $R_n$ = the longest distance between the longitudinal axis of the nozzle and an internal wall of the nozzle at the end thereof;
- To = the introduction temperature of the coal feed stream in °R; and
- Tp = the pyrolysis mix temperature in °R. For the configuration shown in FIG. 2, $R_r$ equals the internal radius of the reactor and $R_n$ equals the internal radius of the nozzle.

According to Equation 1, the time required for a particle to reach a wall of the reactor increases as the temperature of the incoming coal and the diameter of the reactor increases and decreases as the temperature of the incoming char, the diameter of the inlet nozzle, and the angle of divergence increase.

The angle of divergence of the spray cone of the coal particles can range from about 10 to about 20 degrees. Turbulent free-jet characteristics are described in *Perry's Chemical Engineering Handbook*, 4th Edition, on page 5–18, where the angle of divergence of the free jet is indicated to be approximately 20 degrees. For most applications $\phi$ can be calculated assuming that $\beta$ is 20 degrees. Where more precision is required, experimentation can be done with colored coal particles and a window in the reactor wall so an observer can note the point of impingement of the coal particles on the reactor wall, and determine $\phi$ thereby.

Equation 1 ignores effects incoming char can have on the path of coal particles in the reactor. Therefore the value of $\phi$ calculated according to Equation 1 is conservative in that where char is introduced into the reactor, coal particles require a time longer than $\phi$ as calculated by Equation 1 to reach a wall of the reactor. Therefore, a reactor designed and operated so that $\theta$ is less than or equal to $\phi$, where $\phi$ is calculated according to Equation 1, has a substantial margin of safety when char is introduced into the reactor along the peripheral wall thereof around the spray cone of the coal.

Calculating $\theta$

The tacky time of the coal, $\theta$, is determined by the simultaneous solution of the following two equations:

$$D^2 = \frac{12K\theta}{\rho C \ln\left[\frac{(Tp - To)}{(Tp - Tt)}\right]} \qquad (2)$$

and $$1/D^2 = \frac{\rho C}{\tau 12K}\, e^{-\alpha/Tp}\left[(E_1(x_a) - E_1(x_b)) - (E_1(x_c) - E_1(x_d))\right] \qquad (3)$$

where

- K is the thermal conductivity of the carrier and fluidizing gases, in combination, Btu/sec-ft-°R;
- $\rho$ is the apparent particle density of the coal, lb/ft$^3$;
- C is the specific heat of the coal, Btu/lb.-°R;
- Tp is the temperature of pyrolysis in °R;
- To is the introduction temperature of the coal feed stream in °R;
- Tt is the temperature of the coal at the end of the tacky period of the coal in °R;
- $\tau$ is the plastic time constant for the coal at a predetermined solid source of heat to coal ratio in seconds;
- $\alpha$ is the exponential temperature factor for detackification of the coal;
- $E_1(x_a)$ is the exponential integral of $x_a = (\alpha/Tt - \alpha/Tp)$;
- $E_1(x_b)$ is the exponential integral of $x_b = (\alpha/To - \alpha/Tp)$;
- $E_1(x_c)$ is the exponential integral of $x_c - \alpha/Tt$; and
- $E_1(x_d)$ is the exponential integral of $x_d = \alpha/To$.

The exponential integral, $E_1$, is an operator as described in the *Handbook of Mathematical Functions*, (National Bureau of Standards AMS55), 1964, page 228, definition 5.1.1. This exponential integral is expressed as:

$$E_1(x) = \int_x^{\infty} \frac{e^{-q}\,dq}{q} \tag{4}$$

where q is a dummy variable and x represents $x_a$, $x_b$, $x_c$ and $x_d$ as defined above.

Equations 2 and 3 are based on a physical model of detackification of coal where it is assumed that the plastic material responsible for agglomeration of coal particles is driven off or loses its tacky properties during pyrolysis at a rate proportional to the concentration of the plastic material in the coal. It is assumed that the rate constant for detackification of the coal is dependent upon the temperature of the coal according to the Arrhenius equation where $\alpha$ is equal to the activation energy of detackification divided by the gas constant R, which equals 1.98BTU/lbmole-°R. $\tau$, the plastic time constant of the coal, represents the duration, in seconds, of the plastic state of a coal particle which is suddenly heated to an infinitely high temperature. In order to prevent plugging of the pyrolysis reactor it is necessary that $\phi$ be greater than or equal to $\tau$ for it is impossible to detackify a coal particle in a time shorter than $\tau$.

Analysis of equations 2 and 3 indicates that the tacky time $\theta$ of coal can be controlled by such process parameters as the inlet coal temperature, the maximum coal particle size, the pyrolysis temperature, the type of coal processed, and the char-to-coal ratio (defined as "Y" herein). Generally, the larger the maximum particle size of the coal feed, the lower the pyrolysis temperature, the lower the temperature of the incoming coal and, as described in detail below, the lower the char-to-coal ratio, the longer the tacky time. With a long tacky time, a large value of $\phi$ is required to prevent plugging of a pyrolysis reactor. However, to attain a large $\phi$, a large diameter reactor can be required with attendant increase in capital and operating costs for the process. Therefore, generally it is desirable to maintain $\theta$ as low as possible.

A low tacky time for coal can be effected by comminuting the coal to a small particle size, by operating the reactor at a high pyrolysis temperature, by preheating the coal feed, by using a high char-to-coal ratio, and by selecting a coal which detackifies quickly, i.e., a coal with low values for $\alpha$ and $\tau$. However, these process parameters can be manipulated only within certain constraints. For example, the inlet temperature of the coal, $T_0$, must be less than the temperature at which the coal begins to plasticize or else the coal plugs the inlet nozzle of the reactor. The pyrolysis temperature $T_p$ must be less than the temperature at which slag forms, which is about 2000° F. The char-to-coal ratio is limited because at very high particulate source of heat-to-coal ratios, the cost of maintaining a circulating inventory of the solid particulate source of heat can be uneconomically high.

As another example, if the coal is comminuted to a very small particle size, the capital and operating costs of comminution substantially increase. Furthermore, the coal when finely comminuted contains a substantial percentage of fines which tend to be carried over with the vapor mixture from the solids/gas separator, thereby contaminating the hydrocarbon products.

Therefore, all of the process parameters affecting the value of $\theta$ are controlled, as well as the parameters affecting the value of $\phi$, to prevent plugging of a pyrolysis reactor used for an agglomerative coal.

The temperature of the coal at the end of its tacky period, $T_t$, is not capable of measurement. However, because the equations 2 and 3 are simultaneous equations which can be solved for $T_t$ and any other variable, it is not necessary to be able to measure $T_t$ to make use of these equations.

It was noted that as the value of the variable Y increases, which represents the weight ratio of the particulate source of heat to coal introduced into a pyrolysis reactor, the value of $\tau$ decreases. Since $\theta$ increases with $\tau$, higher particulate source of heat to coal weight ratios result in faster detackifaction of an agglomerative coal. This is believed attributable to a smearing effect of the particulate source of heat, where volatile matter responsible for the agglomerative characteristics of coal is wiped from the surface of coal particles by surrounding source of heat particles. However, as shown below, $\tau$ approaches an asymptotic value as Y increases much above 5. This is believed to occur because at a value of about 5 for Y, each coal particle is surrounded by source of heat particles, so the addition of more source of heat particles has little or no effect on wiping of volatile matter from the coal by the source of heat.

The values of $\alpha$ and $\tau$ depend upon the particular type of coal being pyrolyzed. It has been found that Equations 2 and 3 can be applied for the pyrolysis of West Kentucky coals where it is assumed $\alpha$ equals 26,040°R and $\tau$ equals the greater of $1\times10^{-9}$ seconds and the value calculated according to the equation $$\tau = (3-0.7Y)\times10^{-9} \tag{5}$$

where Y equals the weight ratio of particulate source of heat to coal as defined above.

Figure 3:
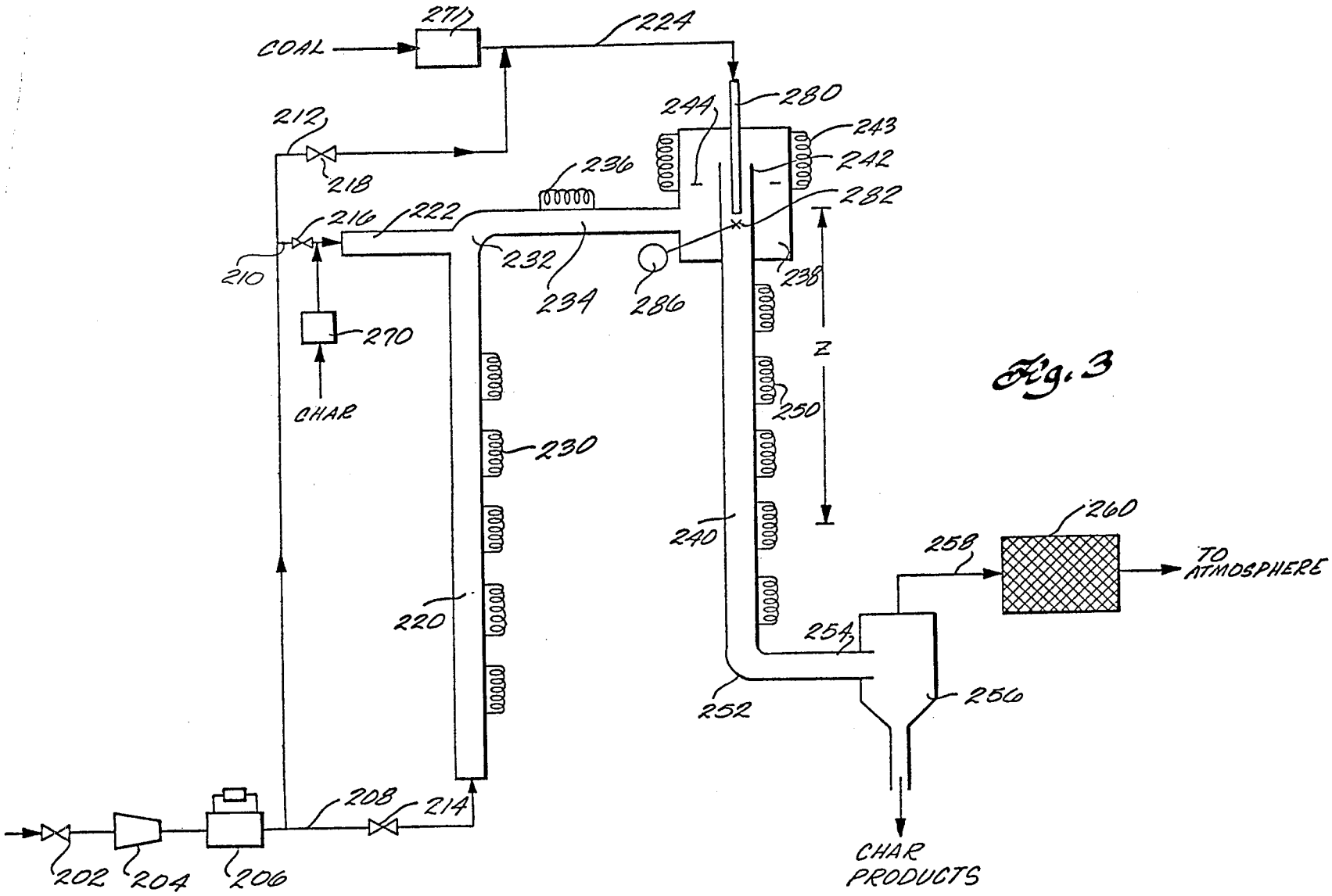
FIG. 3 shows experimental apparatus useful for evaluating $\alpha$ and $\tau$ of an agglomerative coal.

$\alpha$ and $\tau$ can be determined for a particular type of coal using the method schematically shown in FIG. 3.

Referring to FIG. 3, a source of dry nitrogen is provided where the nitrogen sequentially passes through a valve 202, a pressure regulator 204 and a flow meter 206 into lines 208, 210 and 212, each of which has a shut off valve 214, 216, 218, respectively. These lines lead to a preheater 220, char transfer line 222, and coal transfer line 224, respectively. The flow rate of nitrogen through each of the lines is determined by sequentially opening up the valve for each line and then calculating the increment in flow rate as measured by the flow meter 206.

The preheater 220 is a vertically oriented one-inch diameter schedule 40 pipe, jacketed with five electric heaters 230 and packed with ¼ inch diameter alumina granules which aid in heat transfer. The preheater at its top has an elbow 232 leading to an unpacked horizontal section 234 of the preheater having an electric heater 236. The horizontal section 234 terminates in a vertical annular fluidizing chamber 238 formed from an end of 2-inch diameter schedule 40 pipe. Inserted through the bottom of the fluidizing chamber is a 132 inches long piece of 1-inch diameter schedule 40 pipe which serves as a pyrolysis reactor 240. The horizontal section 234 discharges into the fluidizing chamber 238 at a point lower than the top edge 242 of the reactor 240. Concentric rings 244 surround the top portion 242 of the reactor above the end of the horizontal section 234 to prevent channelization of feed streams passing from the fluidizing chamber 238 into the reactor. Heaters 243 are provided for the fluidizing chamber.

The reactor 240 has five electric heaters 250 to compensate for heat losses to the surroundings during pyrolysis. The reactor 240 at its bottom end has an elbow 252 leading to a horizontal section 254 terminating in a cyclone 256 for separating coal and char feed from carrier and hot gas streams 258. The gas streams from the cyclone pass through a filter 260 before discharge to the atmosphere to remove any entrained fines.

Char, when used, is introduced to the reactor by means of a solids feeder 270 into line 222 through which it is carried by a fluidizing stream of nitrogen. The char, after mixing with hot nitrogen from the preheater 220 at the elbow 232, then passes along the horizontal section 234 of the hot gas heater into the fluidizing chamber 238, through the concentric rings 244, and over the top edge of the reactor 242 into the reactor.

To introduce coal to the reactor, a solids feeder 271 is provided. The feeder 271 discharges coal into line 224 where it is combined with nitrogen carrier gas from line 212. The combined stream of the coal and the nitrogen carrier gas in line 224 is discharged into an upright ⅜-inch diameter 20-gauge piece of tubing 280 extending downwardly through the fluidizing chamber, and 4 inches into the pyrolysis reactor 240. At the point 282 marked by an X in FIG. 3, the hot gas from the preheater 220 and the char and its nitrogen carrier gas are combined with the incoming coal with its nitrogen fluidizing gas.

A manometer (not shown) is provided for measuring pressure in the fluidizing chamber and the outlet of the pyrolysis reactor leading to the cyclone. Temperature sensors (not shown) are provided to measure the gas temperature in the preheater and to measure the skin temperature of the pyrolysis reactor. A retractable temperature indicator 286 is provided to measure the temperature at the discharge of the coal feed inlet 280 at point 282.

The use of this apparatus to determine values of $\alpha$ and $\tau$ for an agglomerative coal is demonstrated by the following examples.

EXAMPLES 1-9

Examples 1-9 were conducted to determine the values for $\alpha$ and $\tau$ for an agglomerative bituminous Kentucky No. 9 coal from the Hamilton #1 mine without the presence of a particulate source of heat, using the apparatus of FIG. 3. The reactor was preheated by means of nitrogen gas having passed through the preheater 220. The heaters 243 for the fluidizing chamber were not used. Once desired temperatures were attained, comminuted Hamilton coal was introduced with its carrier gas through inlet 280 and combined with the hot nitrogen gas stream. The run was continued until the pressure drop across the reactor exceeded 7 inches of water, thereby indicating that the reactor was at least partially plugged. At the end of a run, the reactor was allowed to cool, and then the inside of the reactor was inspected to determine the area where the coal particles deposited on the walls of the reactor. It was found that particles deposited on the reactor walls with a discrete starting and stopping point. The distance between the coal inlet and the stopping point of particle deposition on the reactor walls, which is identified by the distance Z in FIG. 3, was measured with a steel tape. This distance was interpreted to be the position where the largest coal particles in the coal feed had detackified.

Figure 5:
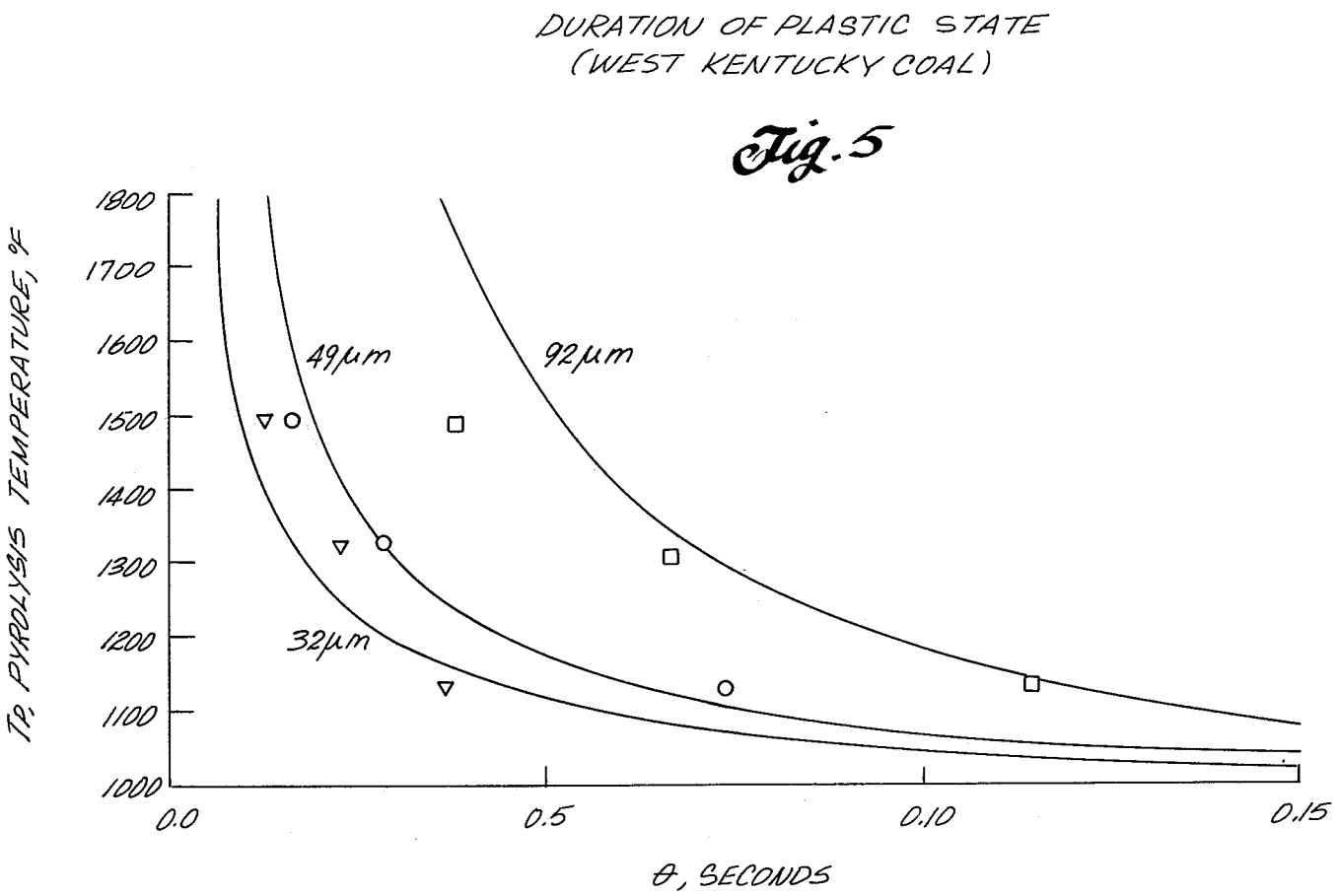
FIGS. 5 and 6 show the experimentally determined relationship between pyrolysis temperature and duration of plastic state for West Kentucky coal and Pittsburgh seam coal, respectively.

The process parameters for experiments 1-9, as well as the results of the experiments, are presented in Table I. The results are presented graphically in FIG. 5. All feed rates and temperatures were directly measured. The coal and the fluidizing gas for the coal were at ambient temperature. The inlet velocity of the gas, $V_g$, refers to the inlet velocity of the combined stream comprising the hot gas and the coal transport gas at the injection point 282 of the coal. This inlet velocity is determined from the feed rate of the hot gas and coal carrier gas using the ideal gas equation, where the cross-sectional area of the reactor at the coal inlet point was 0.006 square feet, the pressure was assumed to be ambient, and the temperature was assumed to be the pyrolysis temperature.

To determine the pyrolysis temperature $T_p$ the preheat temperature of the hot gas was measured with temperature sensor 286 before the coal and its carrier gas were introduced into the reactor. Then the temperature sensor 286 was withdrawn, because it was found when it was left in place the coal caked on the sensor. The pyrolysis temperature, $T_p$, was determined by an energy balance on the streams introduced to the pyrolysis reactor, assuming adiabatic operation in the reactor due to the heaters 250 along the reactor 240.

The percent weight moisture and percent weight volatile matter contents were determined according to ASTM method D-271. The apparent particle density, $\rho$, was determined by ASTM method D167-73. The inlet velocity of the coal, $v_p$, was assumed to be the inlet velocity of the coal transport gas as determined by the ideal gas equation.

The coal samples were obtained by repeatedly comminuting and sieving coal to obtain a coal sample of narrow particle size distribution. The maximum particle size of the coal, D, was confirmed by running the coal sample through an electronic particle size counter manufactured by High Accuracy Products Corporation of Claremont, Calif., Model No. PC-305-SS-TA.

For each experiment, the value of $\theta$ was calculated from the following version of the Stoke's equation:

$$Z = \frac{v_n - v_p}{w} e^{-w\theta} - \frac{v_n - v_p}{w} + v_n\theta \tag{6}$$

where $$w = 18\,\mu/D^2\rho^2; \tag{7}$$

$$v_n = v_g + \frac{g(\rho - \rho_g)D^2}{18\mu}; \tag{8}$$

g is the gravity constant;

$\rho_g$ is the density of the combined stream of the hot gas and the coal carrier gas at the coal feed inlet calculated according to the ideal gas equation;

$\mu$ is the viscosity of the hot gas stream at the coal inlet where the value of $\mu$ was obtained from Tebo, F. J. "*Selected Values of the Physical Properties of Various Materials,*" ANL-5914 (Argonne National Laboratory) (1958); and Z, $\theta$, $v_g$, $\rho$, and D are as defined above.

Values for $\alpha$ and $\tau$ determined from examples 1-9 are presented in Table II. These values were calculated with equations 2 and 3 using multiple regression analysis, minimizing error in $\theta$. Table II presents the numbers of the experiments used to calculate particular values of $\alpha$ and $\tau$, and the char to coal ratio Y for those experiments, which in the case of experiments 1–9 was zero. Parameters required for the regression analysis were obtained from Table I and from the values calculated for calculating $\theta$ as described above. The thermal conductivity of the gas K was obtained from Powell, et al, "Thermal Conductivity of Selected Materials," NSRDS-NBS8, Nov. 25, 1966. The heat capacity of the coal, C, is the average specific heat of the coal from the coal inlet temperature to the pyrolysis temperature as determined according to the method of A. L. Lee reported in "Heat Capacity of Coal," ACS Division of Fuel Chemistry (Preprint) 12(3), pp. 19–31 (1968), where the specific heat of the coal was adjusted for the presence of moisture.

EXAMPLES 10–13

Examples 10–13 were conducted to determine the effect of presence of a particulate source of heat on the value of $\tau$. The same method and coal used for Examples 1–9 were used for these examples, with the addition of char contained in a fluidizing gas into the reactor through inlet 222. The char used was prepared by devolatilization of a Colorado agglomerative bituminous coal having a weight medium particle size of 26 microns with a maximum particle size of 90 microns. The apparatus shown in FIG. 3 was used except the heaters 243 for the fluidizing chamber were used because more energy input was required because of the high specific heat of the char.

coal was then introduced and pyrolysis temperature was calculated by means of an energy balance assuming adiabatic operation of the pyrolysis reactor.

The process parameters for Examples 10–13 are presented in Table I, as well as the measured value of Z and the value calculated for $\theta$ using Equations 6–8. The values for $v_g$ and $\rho_g$ used in Equations 6–8 are based on the combined stream of the preheat gas, coal carrier gas, and char carrier gas. Table II presents the values of $\alpha$ and $\tau$ for these experiments. These values were determined by assuming that $\alpha$ was equal to 26,040°R, the same value obtained for Examples 1–9, and then calculating $\tau$ using Equations 2 and 3.

TABLE I(a)

| Example | Z (ft) | D (microns) | Tp (° F) | $\eta$ (sec) |
|---|---|---|---|---|
| 1 | 0.97 | 32 | 1499 | .0129 |
| 2 | 1.09 | 49 | 1493 | .0158 |
| 3 | 1.98 | 49 | 1322 | .0278 |
| 4 | 4.71 | 49 | 1134 | .0737 |
| 5 | 2.38 | 92 | 1480 | .0379 |
| 6 | 4.17 | 92 | 1308 | .0657 |
| 7 | 7.25 | 92 | 1141 | .1176 |
| 8 | 2.46 | 32 | 1132 | .0361 |
| 9 | 1.38 | 32 | 1325 | .0177 |
| 10 | 2.53 | 49 | 1137 | .0354 |
| 11 | 1.43 | 49 | 1317 | .0187 |
| 12 | 1.66 | 49 | 1256 | .0160 |
| 13 | 2.72 | 49 | 1066 | .0346 |
| 17 | 9.74 | 35 | 1162 | .1375 |
| 18 | 5.72 | 35 | 1317 | .0707 |
| 19 | 0.93 | 35 | 1424 | .0117 |
| 20 | 5.93 | 35 | 1103 | .0875 |

TABLE I(b)

| | | | GAS RATES (SCFM at 60° F) | | | | | |
|---|---|---|---|---|---|---|---|---|
| Example | Coal Feed Rate (lb/hr) | Char Feed Rate (lb/hr) | Coal Gas | Char Gas | Hot Gas | Preheat Temp (° F) | Ambient Temp (° F) | Ambient Press. ("Hg) |
| 1 | 0.540 | 0 | 0.4 | 0 | 7.2 | 1625 | 70 | 29.20 |
| 2 | 0.570 | 0 | 0.4 | 0 | 7.2 | 1625 | 73 | 29.30 |
| 3 | 0.570 | 0 | 0.4 | 0 | 7.6 | 1430 | 78 | 29.10 |
| 4 | 0.570 | 0 | 0.4 | 0 | 7.2 | 1230 | 72 | 29.27 |
| 5 | 0.691 | 0 | 0.4 | 0 | 7.2 | 1620 | 72 | 29.17 |
| 6 | 0.691 | 0 | 0.4 | 0 | 7.2 | 1430 | 72 | 29.30 |
| 7 | 0.691 | 0 | 0.4 | 0 | 7.2 | 1245 | 74 | 29.20 |
| 8 | 0.540 | 0 | 0.8 | 0 | 7.2 | 1278 | 72 | 29.18 |
| 9 | 0.570 | 0 | 0.8 | 0 | 7.6 | 1490 | 70 | 29.20 |
| 10 | 0.570 | 1.679 | 0.1 | 0.4 | 8.0 | 1215 | 68 | 29.10 |
| 11 | 0.570 | 5.722 | 0.4 | 0.6 | 8.0 | 1395 | 67 | 28.90 |
| 12 | 0.570 | 5.662 | 0.4 | 0.6 | 8.0 | 1330 | 71 | 29.24 |
| 13 | 0.570 | 11.28 | 1.0 | 1.0 | 8.0 | 1160 | 69 | 29.29 |
| 17 | 0.444 | 0 | 0.8 | 0 | 7.2 | 1170 | 80 | 29.01 |
| 18 | 0.444 | 0 | 1.2 | 0 | 7.2 | 1545 | 80 | 29.07 |
| 19 | 0.444 | 0 | 1.2 | 0 | 7.2 | 1672 | 82 | 29.01 |
| 20 | 0.444 | 0 | 0.8 | 0 | 7.2 | 1238 | 82 | 29.06 |

TABLE I(c)

| Example | Vp (ft/sec) | Vg (ft/sec) | Coal Moisture (wt %) | Coal Volatiles (wt %) | $\rho$ (lb/ft$^3$) |
|---|---|---|---|---|---|
| 1 | 13.7 | 81.5 | 2.90 | 33.50 | 58.0 |
| 2 | 13.8 | 81.0 | 4.41 | 36.72 | 58.0 |
| 3 | 14.0 | 78.3 | 4.41 | 36.72 | 58.0 |
| 4 | 13.7 | 66.1 | 4.41 | 36.72 | 58.0 |
| 5 | 13.8 | 80.8 | 4.83 | 33.58 | 59.9 |
| 6 | 13.8 | 66.6 | 4.83 | 33.58 | 59.9 |
| 8 | 27.6 | 67.8 | 2.90 | 33.50 | 58.0 |
| 9 | 27.4 | 82.1 | 2.90 | 33.50 | 58.0 |
| 10 | 13.7 | 79.2 | 4.41 | 36.72 | 58.0 |
| 11 | 13.8 | 90.3 | 4.41 | 36.72 | 58.0 |
| 12 | 13.7 | 86.2 | 4.41 | 36.72 | 58.0 |
| 13 | 34.1 | 86.8 | 4.41 | 36.72 | 58.0 |
| 17 | 28.2 | 71.5 | 0.97 | 38.26 | 80.0 |
| 18 | 42.1 | 82.1 | 0.97 | 38.26 | 80.0 |
| 19 | 42.4 | 87.2 | 0.97 | 38.26 | 80.0 |
| 20 | 28.2 | 68.8 | 0.97 | 38.26 | 80.0 |

To determine the pyrolysis temperature, $T_p$, the preheat temperature resulting from introduction of the char, the hot gas, the fluidizing gas for the char, and the fluidizing gas for the coal was measured with temperature sensor 286. Once this temperature stabilized, the

TABLE II

| Example | Y | $\alpha$ (° R) | $\tau$ |
|---|---|---|---|
| 1–9 | 0 | 26,040 | $3.01 \times 10^{-9}$ |
| 10 | 3 | 26,040 | $1.0 \times 10^{-9}$ |

TABLE II-continued

| Example | Y | $\alpha$ (° R) | $\tau$ |
|---|---|---|---|
| 11-12 | 10 | 26,040 | $0.6 \times 10^{-9}$ |
| 13 | 20 | 26,040 | $0.44 \times 10^{-9}$ |
| 17-20 | 0 | 13,750 | $1.6 \times 10^{-9}$ |

TABLE III

| WEST KENTUCKY COAL | | PITTSBURGH SEAM COAL | |
|---|---|---|---|
| 1100° F | 0.107 seconds | 1100° F | 0.166 seconds |
| 1300° F | 0.051 seconds | 1300° F | 0.095 seconds |
| 1500° F | 0.035 seconds | 1500° F | 0.067 seconds |

Figure 4:
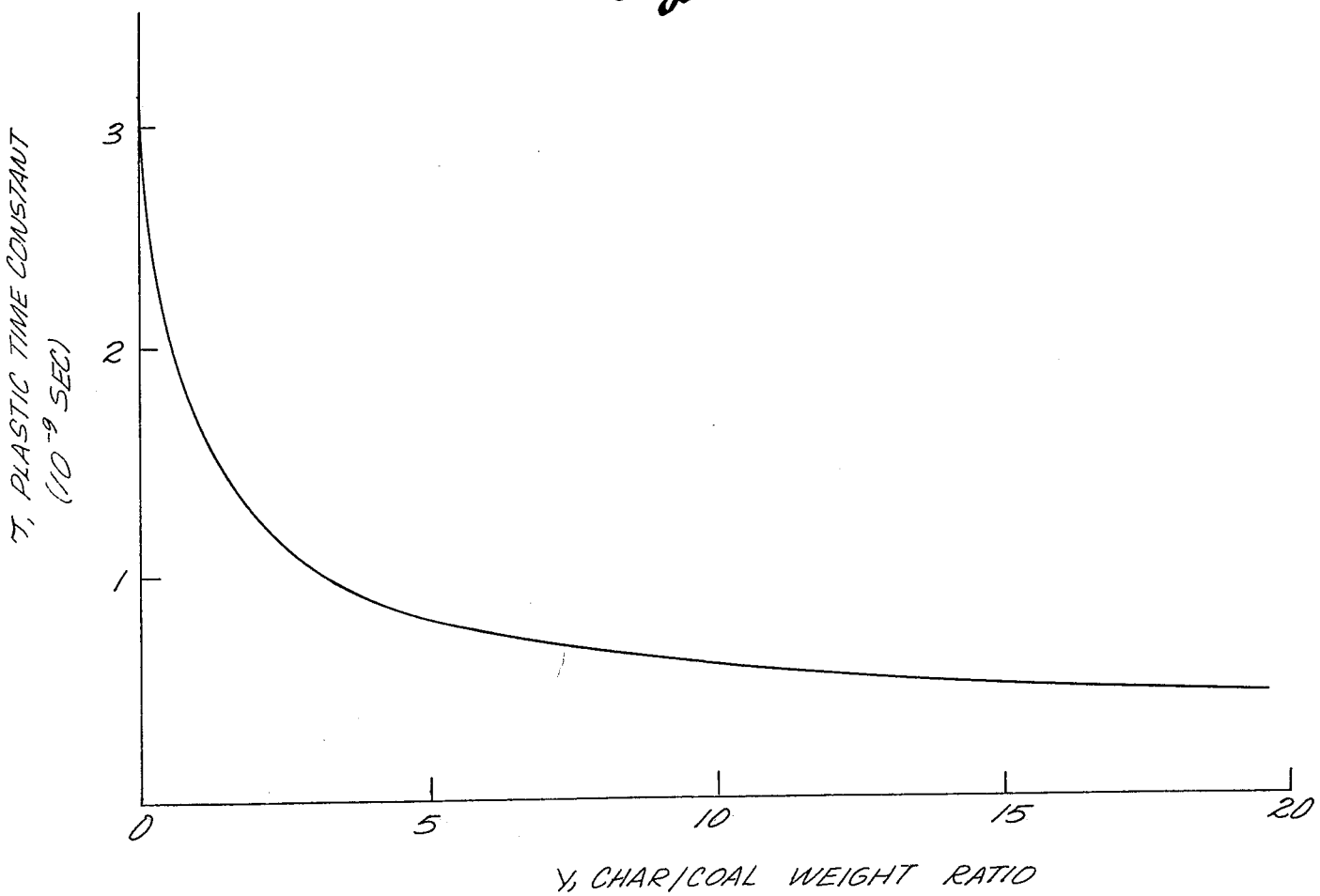
FIG. 4 shows the experimentally determined relationship between $\tau$ and the weight ratio of particulate source of heat to coal for an agglomerative West Kentucky coal.

A graphical representation of $\tau$ versus the char-to-coal ratio is presented in FIG. 4. As expected, $\tau$ decreases with increased char-to-coal ratio due to the wiping effect of the char. However, at high char-to-coal ratios, $\tau$ approaches an asymptotic value indicating diminishing returns from adding more particulate source of heat to the pyrolysis reactor.

EXAMPLE 14

This example demonstrates how the method of this invention can be used to determine the maximum particle size to which an agglomerative coal is comminuted to prevent plugging in a pyrolysis reactor. A reactor having the configuration as shown in FIG. 1 was chosen where the mixing section of the reactor is constructed from 10-inch schedule 10S pipe and the coal inlet is constructed from 1-inch schedule 40S pipe. A Hamilton coal, the coal used for Examples 1-9 is introduced at a rate of 200 pounds per hour contained in a 40 SCFM stream of nitrogen at 60° F. Char resulting from pyrolysis of the Hamilton coal at the rate of 2,000 pounds per hour to give a char-to-coal ratio of 10:1 is injected through the char inlet and fluidized by 2 SCFM of nitrogen at 60° F. The char is heated to a temperature of 1262° F. to provide a pyrolysis temperature of 1075° F.

These values yield an injection velocity for the coal of 92.25 feet per second, and a Reynolds number for the coal carrier gas of 2,917, which is in the turbulent region.

By applying equation 1, it was determined that $\phi$ was equal to 0.296 seconds, i.e., the shortest time it takes a coal particle to reach the wall of the reactor is 0.296 seconds. This calculation was made assuming an angle of divergence of 20°.

Using equations 2 and 3 and the values for $\alpha$ and $\tau$ for examples 11 and 12 as reported in Table II, the maximum particle size D for a coal particle in the feed stream to prevent plugging of the reactor was determined to be 200 microns. Therefore by providing a coal feed stream where the maximum particle size of the coal is 200 microns or less, plugging of the reactor does not occur.

EXAMPLES 15 A-B

These examples demonstrate how the method of this invention was used to determine the temperature at which to pyrolyze an agglomerative coal to prevent plugging in a pyrolysis reactor. A reactor having the configuration as shown in FIG. 1 without a fluidizing chamber where char was distributed by means of screens was used. The mixing section of the reactor was constructed from 4-inch schedule 10S pipe and the coal inlet was constructed from ½-inch schedule 40S pipe. A Hamilton coal, the coal used for Examples 1-9, was introduced at a rate of 20.4 pounds per hour contained in a 16 SCFM stream of nitrogen at 60° F. after comminution to 75 microns. Char resulting from pyrolysis of the Hamilton coal at the rate of 1800 pounds per hour to give a char-to-coal ratio of 88:1 was injected through the char inlet and fluidized by 2 SCFM of nitrogen at 60° F.

By applying equation 1, it was determined that $\phi$ was equal to 0.052 second. This calculation was made assuming an angle of divergence of 15°.

Using equations 2 and 3, it was determined that the pyrolysis temperature had to be maintained at greater than 1150° F. to prevent plugging. Although the char to coal weight ratio for example 13 was lower than the ratio of this example, use of $\tau$ and $\alpha$ from example 13 introduced little, if any error, because of the asymptotic behavior of $\tau$ at higher char to coal ratios.

The reactor was then operated at 1250° F. for example 15A for longer than an hour without any indication of plugging.

However, for example 15B, when the same reactor was operated under similar conditions except the pyrolysis temperature was 1080° F., plugging occurred almost immediately as indicated by increased pressure drop across the reactor.

EXAMPLE 16

The experiment of example 15A was repeated except no fluidizing gas was provided with the char. The reactor quickly plugged upstream of the end of the coal inlet due to backmixing of the coal particles.

EXAMPLES 17-20

Figure 6:
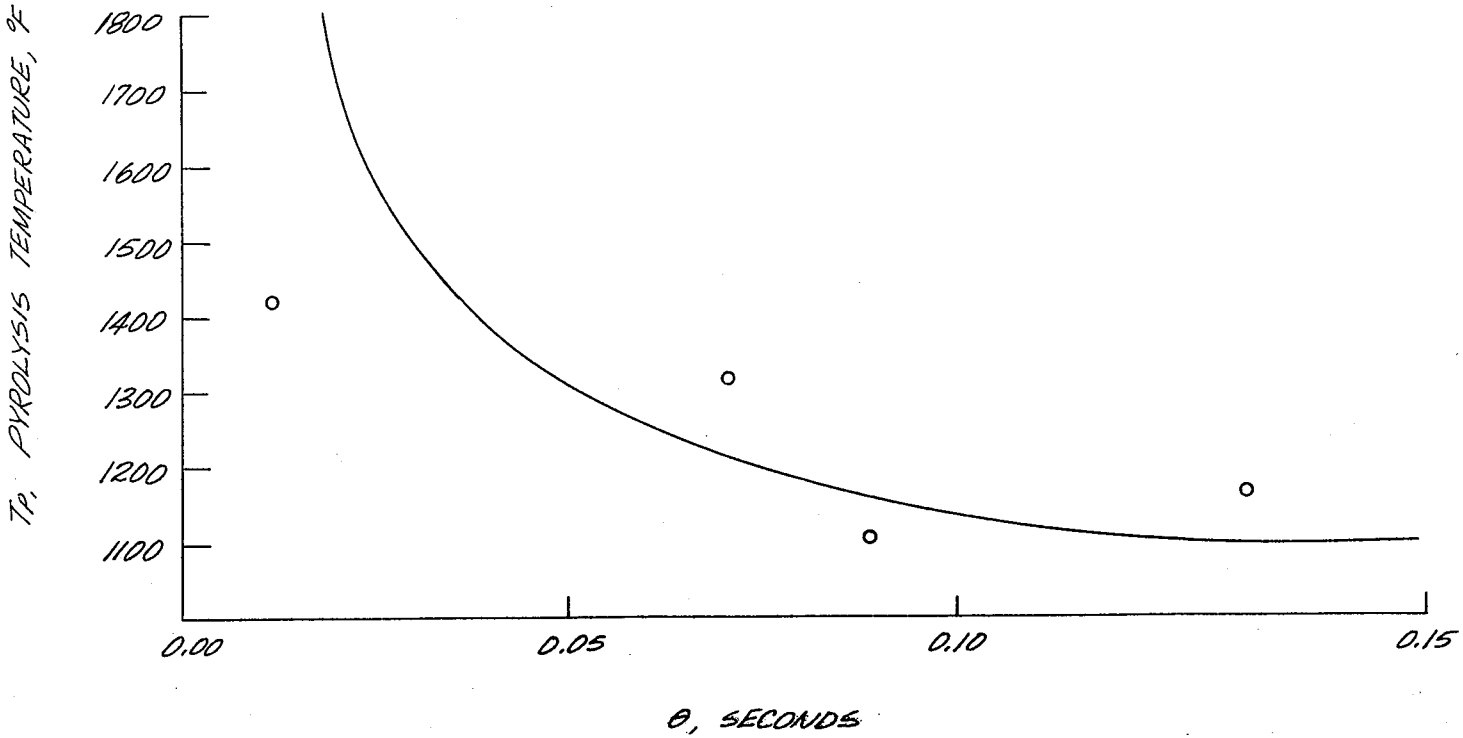

Examples 17-20 were conducted to determine the values for $\alpha$ and $\tau$ for an agglomerative Pittsburgh Seam Coal obtained from the Pittsburgh Energy Research Center Bruceton Experimental Mine without the presence of a particulate source of heat. The method and apparatus used were the same as for Examples 1-9. The process parameters and the results for these tests are reported in Table I and are presented graphically in FIG. 6.

EXAMPLE 21

Figure 7:
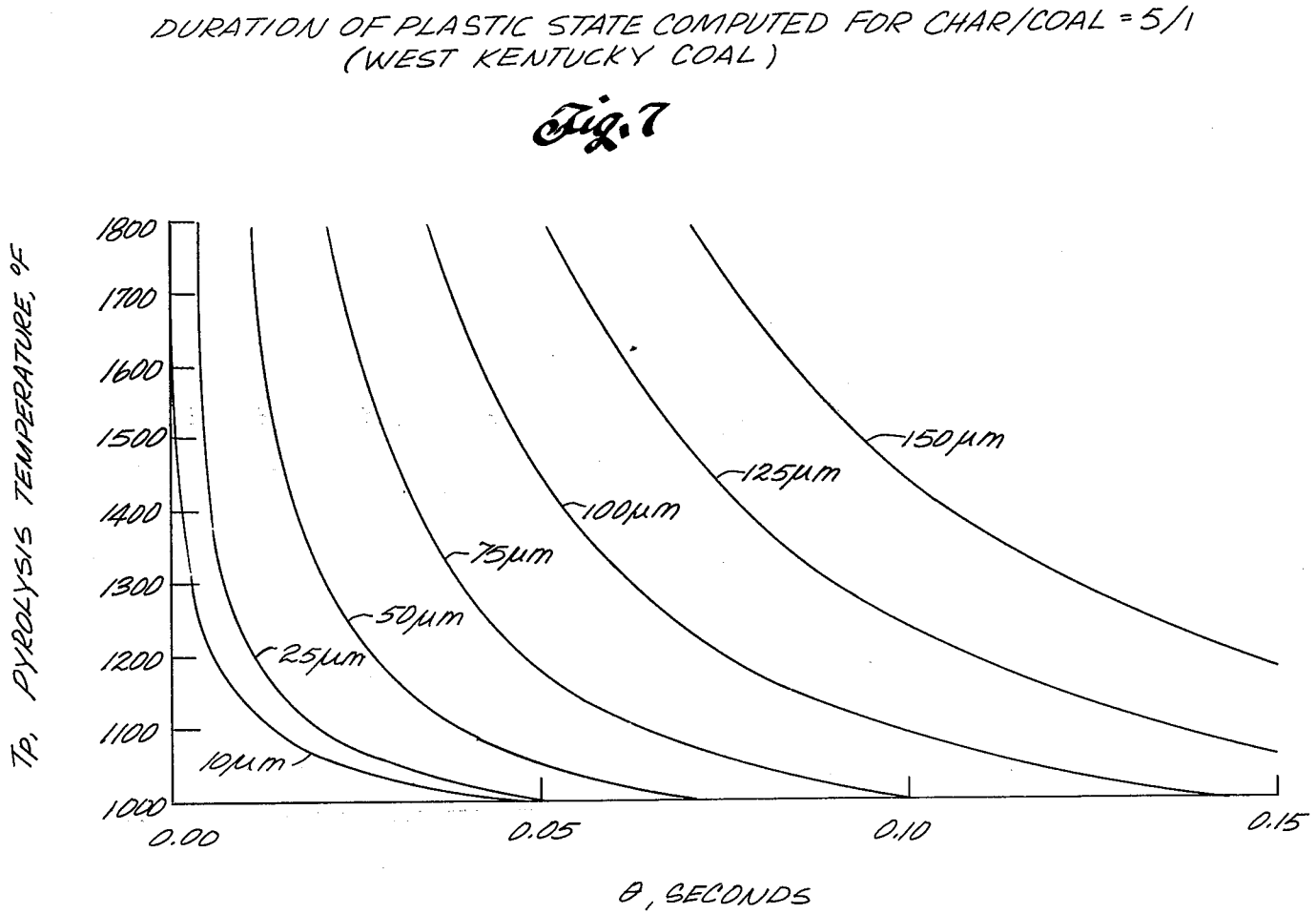
FIG. 7 shows the computed relationship between duration of plastic state and pyrolysis temperature for West Kentucky coal.

Using the values for $\alpha$ and $\tau$ reported in Table II, and equations 2 and 3, the effect of pyrolysis temperature and coal particle size for West Kentucky Coal pyrolyzed in the presence of char at a char to coal mass rate of 5:1 was determined. The results are presented in FIG. 7.

EXAMPLE 22

Using the values for $\alpha$ and $\tau$ reported in Table II and equations 2 and 3, $\theta$ was calculated for both West Kentucky Coal and Pittsburgh Seam Coal at a pyrolysis temperature of 1100° F., 1300° F., and 1500° F. using 200 mesh coal with no char dilution. The results are presented in Table III.

Although this invention has been described in terms of preferred versions thereof, other versions are now obvious to those skilled in the art. For example, although FIG. I shows a descending flow pyrolysis reactor, the method of this invention is applicable to pyrolysis reactors of other configurations, including ascending flow and irregularly shaped reactors and reactors containing baffles.

In addition, it is not necessary to provide a particulate source of heat around the divergent jet of coal. Instead, heat can be provided by electric heaters or the like. However, even without the particulate source of heat, some flow of a gaseous fluid is required to prevent backmixing of the coal with resultant plugging of the reactor.

Because of variations such as these, the spirit and scope of the appended claims should not be limited to the description of the preferred versions of this invention.

What is claimed is:

1. A process for the production of hydrocarbon values from particulate, solid agglomerative coals comprising the steps of:

(a) forming a particulate coal feed stream comprising comminuted particulate agglomerative coal and a carrier gas which is substantially nondeleteriously reactive with respect to the products of pyrolysis of the agglomerative coal for injection as a turbulent, diverging jet stream from an opening into a mixing zone of an elongate pyrolysis reactor having an inner surface and a minimum internal width greater than the maximum width of the opening, simultaneous with the discharge of a particulate solid source of heat in a fluidizing gas which is substantially nondeleteriously reactive with respect to the products of pyrolysis of the agglomerative coal along the peripheral inner surface of the reactor, the diverging stream of particulate coal and solid source of heat combining in the mixing zone of the reactor prior to passage to a pyrolysis zone of the reactor and wherein substantially all of the coal in the feed stream is formed of particles which detackify prior to contact with an interior surface of the pyrolysis reactor closest to the opening;

(b) discharging the particulate source of heat and fluidizing gas into said mixing zone at a temperature greater than the temperature of the pyrolysis zone at a predetermined ratio of particulate source of heat to coal in the feed stream which is sufficient to maintain said pyrolysis zone at the pyrolysis temperature, while simultaneously injecting the particulate coal and carrier gas through the opening at a temperature less than the temperature at which the coal beings to tackify to form a resultant turbulent mixture of the particulate source of heat, the particulate coal and fluidizing and carrier gases in the mixing zone, the quantity of fluidizing gas discharged into said mixing zone with the particulate source of heat being at least sufficient to prevent backflow of the coal from the divergent stream; and (c) passing the resultant turbulent mixture from said mixing zone to the pyrolysis zone of said pyrolysis reactor to pyrolyze the solid particulate coal and yield a pyrolysis product stream containting as solids, the particulate source of heat and a carbon containing solid residue of pyrolysis of the coal, and a vapor mixture of carrier gas and fluidizing gas and pyrolytic vapors comprising volatilized hydrocarbons.

2. The process of claim 1 in which the pyrolysis temperature is above about 1060°R.

3. The process of claim 1 in which the pyrolysis temperature is in the range of from about 1060°R to about 2460°R.

4. The process of claim 1 in which the pyrolysis temperature is in the range of from 1360°R to about 2460°R.

5. The process of claim 1 in which the weight ratio of the solid particulate source of heat to coal in the feed stream is from about 2:1 to about 20:1.

6. A process for the production of hydrocarbon values from particulate, solid agglomerative coals in which solid agglomerative coal particles are injected in the presence of a carrier gas which is substantially nondeleteriously reactive with respect to the products of pyrolysis of the coal particles as a turbulent flow, divergent jet stream from an opening positioned in an elongate pyrolysis reactor having an inner surface, the maximum width of the opening being less than the minimum internal width of the reactor, simultaneous with the injection of a particulate solid source of heat in a fluidizing gas which is substantially nondeleteriously reactive with respect to the products of pyrolysis of the coal particles along the inner peripheral surface of the reactor, the divergent stream of coal particles and solid source of heat combining in a mixing zone of the reactor and entering a pyrolysis zone of the reactor, comprising the following steps for preventing plugging of the reactor:

(a) selecting for the pyrolysis reactor all but one of the variables: $\phi$, the minimum time for a coal particle to travel from the opening to an interior fixed surface of the reactor in seconds; To, the introduction temperature of coal entering the pyrolysis reactor which is less than the temperature at which the coal begins to tackify in °R; Tp, the temperature of the pyrolysis zone in °R; and D, the maximum diameter of the particulate coal particles expressed in feet;

(b) selecting a value for the unselected variable by simultaneous solution of the equations:

$$D^2 = \frac{12K\phi}{\rho C \ln\left[\frac{(Tp - To)}{(Tp - Tt)}\right]}$$

and $$1/D^2 = \frac{\rho C}{\tau 12K} e^{-\alpha/Tp}[(E_1(x_a) - E_1(x_b)) - (E_1(x_c) - E_1(x_d))]$$

wherein

K is the thermal conductivity of the carrier and fluidizing gases, in combination, in Btu/sec-ft-°R;

$\rho$ is the apparent particle density of the coal, lb/ft$^3$;

C is the specific heat of the coal, Btu/lb-°R;

Tt is the temperature of the coal at the end of the tacky period of the coal in °R;

$\tau$ is the plastic time constant for the coal at a predetermined solid source of heat to coal ratio in seconds;

$\alpha$ is the exponential temperature factor for detackification of the coal, °R;

$E_1(x_a)$ is the exponential integral of $x_a = (\alpha/Tt - \alpha/Tp)$;

$E_1(x_b)$ is the exponential integral of $x_b = (\alpha/To - \alpha/Tp)$;

$E_1(x_c)$ is the exponential integral of $x_c = \alpha/Tt$;

$E_1(x_d)$ is the exponential integral of $x_d = \alpha/To$;

(c) injecting solid coal particles having a maximum particle diameter no greater than the selected diameter D, and said carrier gas from the opening into the mixing zone of the pyrolysis reactor at a temperature at least equal to the selected introduction temperature To, simultaneous with injecting the particulate source of heat and fluidizing gas into said mixing zone along the inner surface of said pyrolysis reactor at a predetermined ratio of particulate source of heat to coal particles sufficient to maintain said pyrolysis zone at a temperature at least equal to the selected pyrolysis temperature Tp, the reactor providing a minimum time for a coal particle to travel from the opening to an interior fixed surface of the reactor at least equal to the selected $\phi$ to form a resultant turbulent mixture of the particulate source of heat, the solid coal particles and the carrier and fluidizing gases in the mixing zone, the quantity of fluidizing gas injected into said mixing zone with the particulate source of heat being at least sufficient to prevent backflow of the coal from the divergent stream; and (d) passing the resultant turbulent mixture from said mixing zone to the pyrolysis zone of said pyrolysis reactor to pyrolyze the solid coal particles and yield a pyrolysis product stream containing as solids, the particulate source of heat and a carbon containing solid residue of pyrolysis of the coal particles, and a vapor mixture comprising carrier gas, fluidizing gas and a pyrolytic vapor comprising volatilized hydrocarbons.

7. The process of claim 6 in which Tp is above about 1060°R.

8. The process of claim 6 in which Tp is in the range of from about 1060°R to about 2460°R.

9. The process of claim 6 in which Tp is in the range of from 1360°R to about 2460°R.

10. The process of claim 6 in which the coal is a West Kentucky Coal and $\tau$ is the greater of $1\times10^{-9}$ sec or $(3 - 0.7\ Y) \times 10^{-9}$ sec wherein Y is the weight ratio of the solid particulate source of heat to coal.

11. The process of claim 6 in which $\alpha$ is 26,040°R.

12. The process of claim 10 in which $\alpha$ is 26,040°R.

13. The process of claim 6 in which the weight ratio of solid particulate source of heat to coal is selected from the range of about 2:1 to about 20:1.

14. A process for the production of hydrocarbon values from particulate, solid agglomerative coals comprising the steps of:

(a) forming a particulate coal feed stream comprising particulate agglomerative coal and a carrier gas which is substantially nondeleteriously reactive with respect to products of pyrolysis of the coal for introduction as a turbulent, diverging jet stream from an opening into a mixing zone of an elongate pyrolysis reactor, the reactor having an inner surface, the maximum width of the opening being less than the minimum internal width of the reactor, simultaneous with the injection of a particulate solid source of heat in a fluidizing gas which is substantially nondeleteriously reactive with respect to the products of pyrolysis of the coal along the inner peripheral surface of the reactor, the divergent stream of particulate coal and solid source of heat combining in the mixing zone of the reactor prior to passage to a pyrolysis zone of the reactor, and wherein substantially all of the particulate coal in the feed stream has a particle size less than a determined maximum diameter D, in feet, which is substantially satisfied by the two equations:

$$D^2 = \frac{12K\phi}{\rho C \ln\left[\frac{(Tp - To)}{(Tp - Tt)}\right]}$$

and $$1/D^2 = \frac{\rho C}{\tau 12K} e^{-\alpha/Tp} [(E_1(x_a) - E_1(x_b)) - (E_1(x_c) - E_1(x_d))]$$

wherein

K is the thermal conductivity of the carrier and fluidizing gases, in combination, in Btu/sec-ft-°R;

$\phi$ is the minimum time required for a coal particle to travel from the opening to an interior fixed surface of the reactor in seconds;

$\rho$ is the apparent particle density of the coal, lb/ft$^3$;

C is the specific heat of the coal, Btu/lb-°R;

Tp is the temperature of pyrolysis in °R;

To is the introduction temperature of the coal in °R;

Tt is the temperature of the coal at the end of the tacky period of the coal in °R;

$\tau$ is the plastic time constant for the coal at a predetermined solid source of heat to coal ratio in seconds;

$\alpha$ is the exponential temperature factor for detackification of the coal, °R;

$E_1(x_a)$ is the exponential integral of $x_a = (\alpha/Tt - \alpha/Tp)$;

$E_1(x_b)$ is the exponential integral of $x_b = (\alpha/To - \alpha/Tp)$;

$E_1(x_c)$ is the exponential integral of $x_c = \alpha/Tt$; and $E_1(x_d)$ is the exponential integral of $x_d = \alpha/To$;

(b) injecting the particulate source of heat and fluidizing gas into said mixing zone at a temperature greater than Tp at a predetermined ratio of particulate source of heat to coal in the feed stream sufficient to maintain said pyrolysis zone at the pyrolysis temperature Tp, while simultaneously introducing the particulate agglomerative coal and said carrier gas from the opening into the mixing zone at the temperature To, which is below the temperature at which the coal begins to tackify, to form a resultant turbulent mixture of the particulate source of heat, the particulate agglomerative coal and the carrier and fluidizing gases in the mixing zone, the quantity of fluidizing gas injected into said mixing zone with the particulate source of heat being at least sufficient to prevent backflow of the coal from the divergent stream; and (c) passing the resultant turbulent mixture from said mixing zone to the pyrolysis zone of said pyrolysis reactor to pyrolyze the particulate coal and yield a pyrolysis product stream containing as solids, the particulate source of heat and a carbon containing solid residue of pyrolysis of the particulate coal, and a vapor mixture of carrier and fluidizing gases and pyrolytic vapors comprising volatilized hydrocarbons.

15. The process of claim 14 in which Tp is above about 1060°R.

16. The process of claim 14 in which Tp is in the range of from about 1060°R to about 2460°R.

17. The process of claim 14 in which Tp is in the range of from 1360°R to about 2460°R.

18. The process of claim 14 in which the coal is a West Kentucky Coal and $\tau$ is the greater of $1\times10^{-9}$ sec or $(3 - 0.7Y) \times 10^{-9}$ sec wherein Y is the weight ratio of the solid particulate source of heat to coal.

19. The process of claim 18 in which $\alpha$ is 26,040°R.

20. The process of claim 14 in which the coal is a West Kentucky Coal and $\alpha$ is 26,040°R.

21. The process of claim 14 in which the weight ratio of solid particulate source of heat to coal in the feed stream is selected from the range of about 2:1 to about 20:1.

22. A process for the production of hydrocarbon values from particulate, solid agglomerative coals comprising the steps of:

(a) forming a particulate coal feed stream comprising particulate agglomerative coal and a carrier gas which is substantially nondeleteriously reactive with respect to products of pyrolysis of the coal for introduction as a turbulent, diverging jet stream from an opening into a mixing zone of an elongate pyrolysis reactor, the reactor having an inner surface, the maximum width of the opening being less than the minimum internal width of the reactor, simultaneous with the injection of a particulate solid source of heat in a fluidizing gas which is substantially nondeleteriously reactive with respect to the products of pyrolysis of the coal along the inner peripheral surface of the reactor, the divergent stream of particulate coal and solid source of heat combining in the mixing zone of the reactor prior to passage to a pyrolysis zone of the reactor, the pyrolysis reactor having a configuration in which the minimum time required for a coal particle to travel from the opening to an interior fixed surface of the reactor in seconds is at least equal to $\theta$ as substantially satisfied by the two equations:

$$D^2 = \frac{12K\theta}{\rho C \ln\left[\frac{(Tp - To)}{(Tp - Tt)}\right]}$$

and $$1/D^2 = \frac{\rho C}{\tau 12K} e^{-\alpha/Tp}[(E_1(x_a) - E_1(x_b)) - (E_1(x_c) - E_1(x_d))]$$

wherein

K is the thermal conductivity of the carrier and fluidizing gases, in combination, in Btu/sec-ft-°R;

$\theta$ is the tacky time for the largest coal particles in seconds;

$\rho$ is the apparent particle density of the coal, lb/ft$^3$;

C is the specific heat of the coal, Btu/lb-°R;

Tp is the temperature of pyrolysis in °R;

To is the introduction temperature of the coal in °R;

Tt is the temperature of the coal at the end of the tacky period of the coal in °R;

$\tau$ is the plastic time constant for the coal at a predetermined solid source of heat to coal ratio in seconds;

$\alpha$ is the exponential temperature factor for detackification of the coal, °R:

$E_1(x_a)$ is the exponential integral of $x_a = (\alpha/Tt - \alpha/Tp)$;

$E_1(x_b)$ is the exponential integral of $x_b = (\alpha/To - \alpha/Tp)$;

$E_1(x_c)$ is the exponential integral of $x_c = \alpha/Tt$;

$E_1(x_d)$ is the exponential integral of $x_d = \alpha/To$;

(b) injecting the particulate source of heat and fluidizing gas into said mixing zone at a temperature greater than Tp at a predetermined ratio of particulate source of heat to coal in the feed stream sufficient to maintain said pyrolysis zone at the pyrolysis temperature Tp, while simultaneously introducing the particulate agglomerative coal and said carrier gas from the opening into the mixing zone at a temperature To, which is below the temperature at which the coal begins to tackify, to form a resultant turbulent mixture of the particulate source of heat, the particulate agglomerative coal and the carrier and fluidizing gases in the mixing zone, the quantity of fluidizing gas injected into said mixing zone with the particulate source of heat being at least sufficient to prevent backflow of the coal from the divergent stream; and (c) passing the resultant turbulent mixture from said mixing zone to the pyrolysis zone of said pyrolysis reactor to pyrolyze the particulate coal and yield a pyrolysis product stream containing as solids, the particulate source of heat and a carbon containing solid residue of pyrolysis of the particulate coal, and a vapor mixture of carrier and fluidizing gases and pyrolytic vapors comprising volatilized hydrocarbaons.

23. The process of claim 22 in which Tp is above about 1060°R.

24. The process of claim 22 in which Tp is in the range of from about 1060°R to about 2460°R.

25. The process of claim 22 in which Tp is in the range of from 1360°R to about 2460°R.

26. The process of claim 22 in which the coal is a West Kentucky Coal and $\tau$ is the greater of $1 \times 10^{-9}$ sec or $(3 - 0.7Y) \times 10^{-9}$ sec wherein Y is the weight ratio of the solid particulate source of heat to coal.

27. The process of claim 26 in which $\alpha$ is 26,040°R.

28. The process of claim 22 in which the coal is a West Kentucky Coal and $\alpha$ is 26,040°R.

29. The process of claim 22 in which the weight ratio of solid particulate source of heat to coal in the feed stream is selected from the range of about 2:1 to about 20:1.

30. A process for the production of hydrocarbon values from particulate, solid agglomerative coals comprising the steps of:

(a) forming a particulate coal feed stream comprising comminuted particulate agglomerative coal and a carrier gas which is substantially nondeleteriously reactive with respect to the products of pyrolysis of the coal for introduction as a turbulent, diverging jet stream from an opening into a mixing zone of an elongate pyrolysis reactor, the reactor having a peripheral inner surface and a pyrolysis zone, the minimum width of the pyrolysis reactor being greater than the maximum width of the opening, simultaneous with the injection of a gaseous fluid which is substantially nondeleteriously reactive with respect to the products of pyrolysis of the coal along the peripheral inner surface of the reactor, the divergent feed stream of particulate coal and the fluid combining in the mixing zone of the reactor prior to passage to a pyrolysis zone, wherein substantially all of the coal in the feed is selectively formed of particles which detackify prior to contact with an interior surface of the pyrolysis reactor closest to the opening;

(b) injecting the gaseous fluid along the peripheral inner surface of the reactor while simultaneously introducing the particulate coal feed stream into the mixing zone through the opening at a temperature less than the temperature at which the coal begins to tackify to form a resultant turbulent mixture of the fluid, the particulate coal and the carrier gas in the mixing zone, the quantity of the gaseous fluid injected along the peripheral inner surface being at least sufficient to prevent backflow of the coal from the divergent stream; and (c) passing the resultant turbulent mixture from said mixing zone to the pyrolysis zone of said pyrolysis reactor maintained at a pyrolysis temperature sufficient to pyrolyze the solid particulate coal and yield a pyrolysis product stream containing as solids, a carbon containing solid residue of pyrolysis of the coal in the feed stream, and a vapor mixture of the fluid, the carrier gas and pyrolytic vapors comprising volatilized hydrocarbons.

31. The process of claim 30 in which the pyrolysis temperature is above about 1060°R.

32. The process of claim 30 in which the pyrolysis temperature is in the range of from about 1060°R to about 2460°R.

33. The process of claim 30 in which the pyrolysis temperature is in the range of from 1360°R to about 2460°R.

34. A process for the production of hydrocarbon values from particulate, solid agglomerative coals in which particulate, solid agglomerative coal is injected in the presence of a carrier gas which is nondeleteriously reactive with respect to the products of pyrolysis of the coal as a turbulent flow, divergent jet stream from an opening positioned in an elongate pyrolysis reactor having an inner surface, the maximum width of the opening being less than the minimum width of the reactor, simultaneous with the injection of a gaseous fluid which is substantially nondeleteriously reactive with respect to the products of pyrolysis of the coal along the inner peripheral surface of the reactor, the coal and carrier gas and fluid combining in a mixing zone of the reactor and entering a pyrolysis zone, comprising the following steps for preventing plugging of the reactor:

(a) selecting for the pyrolysis reactor all but one of the variables: $\phi$, the minimum time for the coal particles to reach an internal surface of the reactor from the opening in seconds; To, the initial temperature of coal entering the pyrolysis reactor in °R; Tp, the temperature of the pyrolysis zone in °R; and D, the diameter of the particulate solid coal expressed in feet;

(b) selecting a value for the unselected variable by simultaneous solution of the equations:

$$D^2 = \frac{12K\phi}{\rho C \ln\left[\frac{(Tp - To)}{(Tp - Tt)}\right]}$$

and $$1/D^2 = \frac{\rho C}{12K(3 \times 10^{-9}\ \text{sec})} e^{-\alpha/Tp[(E_1(x_a)-E_1(x_b))-(E_1(x_c)-E_1(x_d))]}$$

K is the thermal conductivity of the carrier and fluidizing gases, in Btu/sec-ft-°R;

$\rho$ is the apparent particle density of the coal, lb/ft$^3$;

C is the specific heat of the coal, Btu/lb.-°R;

Tt is the temperature of the coal at the end of the tacky period of the coal in °R;

$\alpha$ is the exponential temperature factor for detackification of the coal, °R;

$E_1(x_a)$ is the exponential integral of $x_a = (\alpha/Tt - \alpha/Tp)$;

$E_1(x_b)$ is the exponential integral of $x_b = (\alpha/To - \alpha/Tp)$;

$E_1(x_c)$ is the exponential integral of $x_c = \alpha/Tt$;

$E_1(x_d)$ is the exponential integral of $x_d = \alpha/To$;

(c) injecting the gaseous fluid along the reactor inner peripheral surface simultaneous with injecting the particulate coal and said carrier gas at the temperature To, which is less than the temperature at which the coal begins to tackify, from the opening into said mixing zone of the pyrolysis reactor, which provides a minimum time for a coal particle to travel from the opening to an interior fixed surface for the reactor at least equal to the selected $\phi$, to form a resultant turbulent mixture of the particulate coal, carrier gas and fluid in the mixing zone, the quantity of the gaseous fluid injected being at least sufficient to prevent backflow of the coal from the divergent stream; and (d) passing the resultant turbulent mixture from said mixing zone to the pyrolysis zone of said pyrolysis reactor to pyrolyze the solid particulate coal and yield a pyrolysis product stream containing a carbon containing solid residue of pyrolysis of the coal, and a vapor mixture of carrier gas, gaseous fluid and a pyrolytic vapor comprising volatilized hydrocarbons.

35. The process of claim 34 in which Tp is above about 1060°R.

36. The process of claim 34 in which Tp is in the range of from about 1060°R to about 2460°R.

37. The process of claim 34 in which Tp is in the range of from 1360°R to about 2460°R.

38. The process of claim 34 in which the coal is a West Kentucky Coal and $\alpha$ is 26,040°R.

39. A process for the production of hydrocarbon values from particulate, solid aggomerative coals comprising the steps of:

(a) forming a particulate coal feed stream comprising particulate aggomerative coal and a carrier gas which is substantially nondeleteriously reactive with respect to products of pyrolysis of the coal for injection as a turbulent, diverging jet stream from an opening into a mixing zone of an elongate pyrolysis reactor having an inner peripheral surface, the maximum width of the opening being less than the minimum internal width of the reactor, simultaneous with the discharge of a gaseous fluid which is substantially nondeleteriously reactive with respect to the products of pyrolysis of the coal along the inner peripheral surface of the reactor, the divergent stream of particulate coal and gaseous fluid combining in the mixing zone of the reactor prior to passage to a pyrolysis zone of the reactor and wherein substantially all of the coal feed formed has a particle size less than a determined maximum diameter D, in feet, which is substantially satisfied by the two equations:

$$D^2 = \frac{12K\phi}{\rho C \ln\left[\frac{(Tp - To)}{(Tp - Tt)}\right]}$$

and $1/D^2 =$

-continued $$\frac{\rho C}{12K(3 \times 10^{-9})} e^{-\alpha/Tp}[(E_1(x_a)-E_1(x_b))-(E_1(x_c)-E_1(x_d))]\text{sec}^{-1}$$

wherein

K is the thermal conductivity of the carrier and fluidizing gases, in combination in Btu/sec-ft-°R;

$\phi$ is the minimum time required for a coal particle to travel from the opening to an internal fixed surface in the reactor in seconds;

$\rho$ is the apparent particle density of the coal, lb/ft$^3$;

C is the specific heat of the coal, Btu/lb-°R;

Tp is the temperature of pyrolysis in °R;

To is the introduction temperature of the coal in °R;

Tt is the temperature of the coal at the end of the tacky period of the coal in °R;

$\alpha$ is the exponential temperature factor for detackification of the coal, ° R.;

$E_1(x_a)$ is the exponential integral of $x_a = (\alpha/Tt - \alpha/Tp)$;

$E_1(x_b)$ is the exponential integral of $x_b = (\alpha/To - \alpha/Tp)$;

$E_1(x_c)$ is the exponential integral of $x_c = \alpha/Tt$; and $E_1(x_d)$ is the exponential integral of $x_d = \alpha/To$;

(b) discharging the fluid into said mixing zone simultaneous with introducing the particulate coal and carrier gas from the opening into the mixing zone at a temperature To, which is below the temperature at which the coal begins to tackify, to form a resultant turbulent mixture of the carrier gas, particulate coal and fluid in the mixing zone, the quantity of the gaseous fluid discharged into said mixing zone being sufficient to prevent backflow of the coal from the divergent stream; and (c) passing the resultant turbulent mixture from said mixing zone to the pyrolysis zone of said pyrolysis reactor to pyrolyze the particulate coal and yield a pyrolysis product stream containing solid residue of pyrolysis of the coal, and a vapor mixture comprising carrier gas and gaseous fluid and pyrolytic vapors comprising volatilized hydrocarbons.

40. The process of claim 39 in which Tp is above about 1060°R.

41. The process of claim 39 in which Tp is in the range of from about 1060°R to about 2460°R.

42. The process of claim 39 in which Tp is in the range of from 1360°R to about 2460°R.

43. The process of claim 39 in which the coal is a West Kentucky Coal and $\tau$ is 26,040°R.

44. A process for the production of hydrocarbon values from particulate, solid agglomerative coals comprising the steps of:

(a) forming a particulate coal feed stream comprising particulate aggomerative coal and a carrier gas which is substantially nondeleteriously reactive with respect to products of pyrolysis of the coal for introduction as a turbulent, diverging jet stream from an opening into a mixing zone of an elongate pyrolysis reactor having an inner peripheral surface, the maximum width of the opening being less than the minimum internal width of the reactor, simultaneous with the injection of a gaseous fluid which is substantially nondeleteriously reactive with respect to the products of pyrolysis of the coal along the inner peripheral surface of the reactor, the divergent stream of particulate coal and gaseous fluid combining in the mixing zone of the reactor prior to passage to a pyrolysis zone of the reactor, the pyrolysis reactor having a configuration in which the minimum time required for a coal particle to travel from the opening to an interior fixed surface of the reactor, in seconds, is at least equal to $\theta$ as substantially satisfied by the two equations:

$$D^2 = \frac{12K\phi}{\rho C \ln\left[\frac{(Tp - To)}{(Tp - Tt)}\right]}$$

and $$1/D^2 = \frac{\rho C}{12K(3 \times 10^{-9}\text{ sec})} e^{-\alpha/Tp}[(E_1(x_a)-E_1(x_b))-(E_1(x_c)-E_1(x_d))]$$

wherein

K is the thermal conductivity of the carrier and fluidizing gases, in combination in Btu/sec-ft-°R;

$\theta$ is the tacky time for the largest coal particles in seconds;

$\alpha$ is the exponential temperature factor for detackification of the coal, °R;

$E_1(x_a)$ is the exponential integral of $x_a = (\alpha/Tt - \alpha/Tp)$;

$E_1(x_b)$ is the exponential integral of $x_b = (\alpha/To - \alpha/Tp)$;

$E_1(x_c)$ is the exponential integral of $x_c = \alpha/Tt$; and $E_1(x_d)$ is the exponential integral of $x_d = \alpha/To$;

$\rho$ is the apparent particle density of the coal, lb/ft$^3$;

C is the specific heat of the coal, Btu/lb-°R;

Tp is the temperature of pyrolysis in °R;

To is the introduction temperature of the coal in °R;

Tt is the temperature of the coal at the end of the tacky period of the coal in °R;

(b) discharging the fluid into said mixing zone simultaneous with injecting the solid particulate coal and said carrier gas from the opening into the mixing zone at a temperature To, which is below the temperature at which the coal begins to tackify, to form a resultant turbulent mixture of the carrier gas, particulate coal and gaseous fluid in the mixing zone, the quantity of gaseous fluid discharged into said mixing zone being sufficient to prevent backflow of the coal from the divergent stream; and (c) passing the resultant turbulent mixture from said mixing zone to the pyrolysis zone of said pyrolysis reactor to pyrolyze the solid particulate coal and yield a pyrolysis product stream containing a carbon containing solid residue of pyrolysis of the coal, and a vapor mixture of carrier gas and gaseous fluid and pyrolytic vapors comprising volatilized hydrocarbons.

45. The process of claim 44 in which Tp is above about 1060°R.

46. The process of claim 44 in which Tp is in the range of from about 1060°R to about 2460°R.

47. The process of claim 44 in which Tp is in the range of from 1360°R to about 2460°R.

48. The process of claim 44 in which the coal is a West Kentucky Coal and $\alpha$ is 26,040°R.

* * * * *